US009888730B2

(12) United States Patent
Spenser et al.

(10) Patent No.: US 9,888,730 B2
(45) Date of Patent: Feb. 13, 2018

(54) AQUATIC SPORT PERFORMANCE GARMENT WITH RESTRAINTS AND METHOD OF MAKING SAME

(71) Applicant: ROKA Sports, Inc., Dallas, TX (US)

(72) Inventors: Kurt R. Spenser, Dallas, TX (US); Robert A. Canales, Dallas, TX (US); Mark C. Stephens, Dallas, TX (US); Nathan Tracy, Dallas, TX (US)

(73) Assignee: ROKA SPORTS, INC., Dallas, TX (US)

( * ) Notice: Subject to any disclaimer, the term of this patent is extended or adjusted under 35 U.S.C. 154(b) by 0 days.

(21) Appl. No.: 15/469,191

(22) Filed: Mar. 24, 2017

(65) Prior Publication Data

US 2017/0280791 A1 Oct. 5, 2017

Related U.S. Application Data

(60) Provisional application No. 62/315,156, filed on Mar. 30, 2016.

(51) Int. Cl.
*A41D 13/012* (2006.01)
*A41D 27/00* (2006.01)
*A41D 7/00* (2006.01)

(52) U.S. Cl.
CPC ..... *A41D 13/012* (2013.01); *A41D 7/00* (2013.01); *A41D 27/00* (2013.01);
(Continued)

(58) Field of Classification Search
CPC ..... A41D 13/012; A41D 7/00; B63C 11/04; B63C 9/093; B63C 9/115
See application file for complete search history.

(56) References Cited

U.S. PATENT DOCUMENTS 1,731,695 A 10/1929 Wright
2,462,361 A * 2/1949 Cassens ..... A41D 1/02 112/417
(Continued)

FOREIGN PATENT DOCUMENTS

FR 2566320 A1 12/1985
GB 2259237 A 3/1993
(Continued)

OTHER PUBLICATIONS

2012 Bluseventy "full sleeve" Reaction wetsuit. http://www.superiormantri.com/shop. (4 pages) (Nov. 20, 2012).
(Continued)

*Primary Examiner* — Tejash Patel
(74) *Attorney, Agent, or Firm* — Wilson Sonsini Goodrich & Rosati

(57) ABSTRACT

An aquatic sport performance garment comprising restraints affixed to a lateral material surface of the aquatic sport performance garment approximately parallel to a sagittal plane along each side of the garment and further comprising restraints affixed to a material surface across the back of the aquatic sport performance garment, posteriorly offset from the coronal plane of the garment in a criss-cross fashion, intersecting the longitudinal axis with the ends of the criss-cross restraints located in proximity to the ends of the longitudinally placed lateral restraints on each side of the garment; said restraints configured to inhibit side-to-side bending of the body of a user, reduce longitudinal drag, improve stroke mechanics, encourage proper torso rotation and muscle coordination about the midsection of the body of the user during movement and improve endurance when the garment is worn by the user when swimming.

20 Claims, 5 Drawing Sheets

(52) U.S. Cl.
CPC ..... *A41D 2400/24* (2013.01); *A41D 2500/52* (2013.01); *A41D 2600/10* (2013.01)

(56) References Cited

U.S. PATENT DOCUMENTS

| | | | | |
|---|---|---|---|---|
| 3,134,994 | A | 6/1964 | Christofferson | |
| 3,771,169 | A * | 11/1973 | Edmund | B63C 11/04 2/125 |
| 4,293,957 | A * | 10/1981 | Melarvie | A41D 13/012 2/2.17 |
| 4,397,636 | A | 8/1983 | Ganshaw | |
| 4,451,934 | A * | 6/1984 | Gioello | A41B 9/00 2/113 |
| 4,473,908 | A | 10/1984 | Knecht | |
| 4,698,847 | A | 10/1987 | Yoshihara | |
| 4,999,845 | A | 3/1991 | Jenks, Jr. et al. | |
| 5,013,271 | A | 5/1991 | Bartlett | |
| 5,022,878 | A | 6/1991 | Casad | |
| 5,052,053 | A | 10/1991 | Peart et al. | |
| 5,191,658 | A | 3/1993 | Meistrell | |
| 5,410,759 | A | 5/1995 | Hari | |
| 5,630,229 | A | 5/1997 | MacHado et al. | |
| 5,768,703 | A | 6/1998 | MacHado et al. | |
| 5,809,567 | A * | 9/1998 | Jacobs | A41D 7/00 2/1 |
| 5,898,934 | A | 5/1999 | Hunter et al. | |
| 5,953,750 | A | 9/1999 | Stella | |
| 7,017,195 | B2 | 3/2006 | Buckman et al. | |
| 7,037,155 | B2 | 5/2006 | Freeman et al. | |
| 7,059,925 | B2 | 6/2006 | Smith et al. | |
| 7,125,302 | B2 | 10/2006 | Haselsteiner | |
| 7,150,667 | B1 | 12/2006 | Leung | |
| 7,233,829 | B2 | 6/2007 | Vlad | |
| 7,460,886 | B2 | 12/2008 | Mazzarolo | |
| 7,464,414 | B2 | 12/2008 | McDuff | |
| D608,077 | S | 1/2010 | Bybee et al. | |
| 7,992,218 | B2 | 8/2011 | O'Hara | |
| 8,032,944 | B2 | 10/2011 | Demetropoulos | |
| 9,572,378 | B2 | 2/2017 | Canales et al. | |
| 2001/0014981 | A1 | 8/2001 | Fairhurst et al. | |
| 2002/0026664 | A1 | 3/2002 | Grounds et al. | |
| 2003/0233694 | A1 | 12/2003 | Wescombe-Down | |
| 2005/0101203 | A1 | 5/2005 | Kemp et al. | |
| 2006/0073749 | A1 | 4/2006 | Turner | |
| 2006/0085889 | A1 | 4/2006 | Okajima | |
| 2006/0230490 | A1 | 10/2006 | Okajima | |
| 2006/0260018 | A1 | 11/2006 | Gordon et al. | |
| 2007/0000015 | A1 | 1/2007 | Alaniz et al. | |
| 2007/0077126 | A1 | 4/2007 | Garcia et al. | |
| 2007/0277278 | A1 | 12/2007 | O'Brien | |
| 2007/0294797 | A1 | 12/2007 | Furgerson et al. | |
| 2008/0141430 | A1 | 6/2008 | Rance et al. | |
| 2009/0004938 | A1 | 1/2009 | Staver et al. | |
| 2009/0038047 | A1 | 2/2009 | Di | |
| 2009/0260125 | A1 | 10/2009 | Grilliot et al. | |
| 2010/0212057 | A1 | 8/2010 | Sullivan | |
| 2010/0225758 | A1 | 9/2010 | Mashiah | |
| 2010/0269238 | A1 | 10/2010 | O'Hara | |
| 2011/0055746 | A1 | 3/2011 | Mantovani et al. | |
| 2011/0151733 | A1 | 6/2011 | Gadler | |
| 2011/0266314 | A1 | 11/2011 | Sommers | |
| 2012/0128425 | A1 | 5/2012 | Walck | |
| 2012/0144541 | A1 | 6/2012 | Mitchell et al. | |
| 2013/0042377 | A1 | 2/2013 | Moore et al. | |
| 2013/0219579 | A1 | 8/2013 | Molyneux et al. | |
| 2014/0313037 | A1 | 10/2014 | Canales et al. | |
| 2015/0082510 | A1 | 3/2015 | Inzer | |
| 2016/0262460 | A1 | 9/2016 | Inzer | |
| 2017/0049159 | A1 | 2/2017 | Canales et al. | |
| 2017/0079339 | A1 * | 3/2017 | Yeomans | A41D 7/005 |

FOREIGN PATENT DOCUMENTS

| | | | |
|---|---|---|---|
| GB | 2529472 | A | 2/2016 |
| JP | 2005263116 | A | 9/2005 |
| WO | WO-9959437 | A1 | 11/1999 |
| WO | WO-2007038794 | A2 | 4/2007 |
| WO | WO-2013082173 | A1 | 6/2013 |

OTHER PUBLICATIONS

BarracudaUSA C1 Womens Comp Wetsuit. www.skylinenw.com. (2 pages) (Nov. 2012).
Blue Seventy Axis Sleeveless Women's New Triathlon Wetsuit. www.wetsuitrental.com (2 pages) (Nov. 20, 2012).
Blue Seventy Wetsuits. www.intelligent-triathlon-training.com/blue-seventy.html. (3 pages) (Nov. 20, 2012).
Co-pending U.S. Appl. No. 15/471,895, filed Mar. 28, 2017.
Demerly. 2XU V:2 Wetsuit—A Collection of Valid Features. TriSports.com (9 pages) (Nov. 20, 2012).
PCT/US2012/066879 International Preliminary Report on Patentability dated Jun. 3, 2014.
PCT/US2012/066879 International Search Report dated Mar. 26, 2013.
Quintana Roo Neoprene Speed Sleeves. www.wetsuitrental.comlquintana-roo-speed-sleeve.html. (1 page) (Nov. 12, 2011).
Sammamish Valley Cycle. Triathlon Gear. (4 pages) (Nov. 20, 2012).
Slowtwitch.com. Product 2007. 2XU. (4 pages) (Nov. 20, 2012).
T:3 Team Wetsuit. www.2xu.com/product/731/T3-Team-Wetsuit./90. (2 pages) (Nov. 20, 2012).
U.S. Appl. No. 14/361,296 Office Action dated Sep. 1, 2016.
U.S. Appl. No. 15/346,654 Office Action dated Jan. 19, 2017.
Wetsuit Wearhouse. blueseventy. Men's Blue Seventy SPRINT Triathlon Wetsuit. (4 pages) (Nov. 20, 2012).
Co-pending U.S. Appl. No. 15/484,707, filed Apr. 11, 2017.
U.S. Appl. No. 15/471,895 First Action Interview dated Jun. 2, 2017.
U.S. Appl. No. 15/484,707 First Action Interview dated Jun. 8, 2017.
U.S. Appl. No. 15/471,895 First Action Interview dated Jul. 11, 2017.
Co-pending U.S. Appl. No. 15/790,637, filed Oct. 23, 2017.
Co-pending U.S. Appl. No. 15/790,706, filed Oct. 23, 2017.
Co-pending U.S. Appl. No. 15/791,754, filed Oct. 24, 2017.

* cited by examiner

AQUATIC SPORT PERFORMANCE GARMENT WITH RESTRAINTS AND METHOD OF MAKING SAME

CROSS-REFERENCE

This application claims the benefit of U.S. Provisional Application No. 62/315,156, filed Mar. 30, 2016, which application is incorporated herein by reference.

BACKGROUND OF THE INVENTION

The present disclosure relates generally to sports performance garments, and more particularly to the design and construction of wetsuits, triathlon garments, aquatic compression garments, aquatic sports performance garments and other swimwear. Various wetsuits have been developed in the art, and are utilized for various purposes. Among these are performance wetsuits, which are popular among triathletes and open-water swimmers. Performance wetsuits provide drag reduction in the form of faster-than-skin surface coatings, warmth and additional buoyancy to the wearer, and are designed to enhance the speed and ease with which the wearer moves through the water while swimming.

SUMMARY OF THE INVENTION

Provided herein is an aquatic sport performance garment configured to inhibit side-to-side bending of a torso of a user when the garment is worn, the garment having a first armpit region, a second armpit region, a first hip region, and a second hip region, the garment comprising: a first longitudinal restraint strip comprising; a first end, a second end, and a first axis extending from the first end to the second end, wherein the first longitudinal restraint strip is affixed to a first material surface of an aquatic performance garment material or is integrated into the aquatic sport performance garment material, and is positioned such that the first axis is approximately parallel to a sagittal plane of a user when the garment is worn along a first lateral aspect of the aquatic sport performance garment from the first armpit region to the first hip region; and a second longitudinal restraint strip comprising; a third end, a fourth end, and a second axis extending from the third end to the fourth end, wherein the second longitudinal restraint strip is affixed to a second material surface of the aquatic performance garment material or is integrated into the aquatic sport performance garment material, and is positioned such that the second axis is approximately parallel to the sagittal plane along a second lateral aspect of the aquatic sport performance garment from the second armpit region to the second hip region. In some embodiments, the aquatic sport performance garment further comprises: a first diagonal restraint strip comprising, a fifth end, a sixth end, and a third axis extending from the fifth end to the sixth end, wherein the first diagonal restraint strip is affixed to a third material surface across a back region of the aquatic performance garment material or is integrated into the aquatic sport performance garment material, and is positioned diagonally such that the third axis is posteriorly offset from a coronal plane of the user when the garment is worn, wherein the fifth end is positioned in contact with or in proximity to the first end of the first longitudinal restraint strip, and the sixth end is positioned in contact with or in proximity to the fourth end of the second longitudinal restraint strip; and a second diagonal restraint strip comprising a seventh end, an eighth end, and a fourth axis extending from the seventh end to the eighth end wherein the second diagonal restraint strip is affixed to the third material surface across the back region of the aquatic performance garment material or is integrated into the aquatic sport performance garment material, and is positioned diagonally such that the fourth axis is posteriorly offset from the coronal plane, wherein the seventh end is positioned in contact with or in proximity to the third end of the second longitudinal restraint strip, and the eighth end of the second diagonal restraint strip is positioned in contact with or in proximity to the second end of the first longitudinal restraint strip, wherein the first diagonal restraint strip and the second diagonal restraint strip form an intersecting "X" pattern, wherein the first diagonal restraint strip and the second diagonal restraint strip are configured to encourage a rolling rotation of the torso of the user when the garment is worn. In some embodiments of the aquatic sport performance garment, the first longitudinal restraint strip and the second longitudinal restraint strip further comprise a first modulus of elasticity that is approximately two or more times greater than a second modulus of elasticity of the aquatic sport performance garment material to which it is affixed or into which it is integrated. In some embodiments of the aquatic sport performance garment, the first diagonal restraint strip and the second diagonal restraint strip further comprise a third modulus of elasticity that is approximately two or more times greater than the second modulus of elasticity of the aquatic sport performance garment material to which it is affixed or integrated, when stretched 10%.

Provided herein is an aquatic sport performance garment configured to encourage a rolling rotation of the torso of a user when the garment is worn, the garment having a first armpit region, a second armpit region, a first hip region, and a second hip region, the garment comprising: a first diagonal restraint strip comprising, a fifth end, a sixth end, and a third axis extending from the fifth end to the sixth end, wherein the first diagonal restraint strip is affixed to a third material surface across a back region of the aquatic performance garment material or is integrated into the aquatic sport performance garment material, and is positioned diagonally such that the third axis is posteriorly offset from a coronal plane of the user when the garment is worn, wherein the fifth end is positioned and affixed along a first lateral aspect of the performance garment at or about the first armpit region approximately parallel to a sagittal plane of the user when the garment is worn, and the sixth end is positioned and affixed along a second lateral aspect of the performance garment at or about the second hip region approximately parallel to the sagittal plane, and a second diagonal restraint strip comprising, a seventh end, an eighth end, and a fourth axis extending from the seventh end to the eighth end, wherein the second diagonal restraint strip is affixed to the third material surface across the back region of the aquatic performance garment material or is integrated into the aquatic sport performance garment material, and is positioned diagonally such that the fourth axis is posteriorly offset from the coronal plane, wherein the seventh end is positioned and affixed along the second lateral aspect of the performance garment at or about the second armpit region approximately parallel to the sagittal plane, and the eighth end is positioned and affixed along the first lateral aspect of the performance garment at or about the first hip region approximately parallel to the sagittal plane; wherein the first diagonal restraint strip and the second diagonal restraint strip form an intersecting "X" pattern, and wherein the first diagonal restraint strip and the second diagonal restraint strip further comprise a third modulus of elasticity that is approximately two or more times greater than a second modulus of elasticity of the aquatic sport performance garment material to which they are affixed or into which they are integrated, when stretched 10%. In some embodiments, the aquatic sport performance garment further comprises: a first longitudinal restraint strip comprising; a first end, a second end, and a first axis extending from the first end to the second end, wherein the first longitudinal restraint strip is affixed to a first material surface of an aquatic performance garment material or is integrated into the first material surface of the aquatic sports performance garment material, and is positioned such that the first axis is approximately parallel to the sagittal plane along the first lateral aspect of the performance garment approximately from the first armpit region to the first hip region; and a second longitudinal restraint strip comprising; a third end, a fourth end, and a second axis extending from the third end to the fourth end, wherein the second longitudinal restraint strip is affixed to a second material surface of the aquatic performance garment material or is integrated into the second material surface of the aquatic sport performance garment material, and is positioned such that the second axis is approximately parallel to the sagittal plane along the second lateral aspect of the performance garment approximately from the second armpit region to the second hip region, wherein the first longitudinal restraint strip and second longitudinal restraint strip are configured to inhibit side-to-side bending of a torso of a user when the garment is worn. In some embodiments of the aquatic sport performance garment, the first longitudinal restraint strip and the second longitudinal restraint strip comprise a first modulus of elasticity that is approximately two or more times greater than the second modulus of elasticity of the aquatic performance garment material to which it is affixed or into which it is integrated, when stretched 10%. In some embodiments of the aquatic sport performance garment, the first longitudinal restraint strip and the second longitudinal restraint strip comprise a first material stiffness greater than a second material stiffness of the aquatic sports performance garment material to which it is affixed, wherein the first or second material stiffness comprises an axial stiffness or a rotational stiffness.

In any one of the embodiments of the aquatic sport performance garment, the material of the aquatic sports performance garment comprises: a rubber material; a nylon material; a rayon material; a polyurethane material; an elastic polyurethane material; a polyester material; or any combination thereof.

In any one of the embodiments of the aquatic sport performance garment, the first longitudinal restraint strip, second longitudinal restraint strip, first diagonal restraint strip and second diagonal restraint strips comprise: a rubber material; a textile material; a commercially pure titanium or titanium alloy; a commercially pure tantalum or tantalum alloy; a commercially pure copper or copper alloy; a silicone material; a neoprene material; a nylon material; a polypropylene material; a rayon material; a polyurethane material; an elastic polyurethane material; a polyester material; a Poly PBT material; a XLA material; or any combination thereof.

In any one of the embodiments of the aquatic sport performance garment, any one of the first longitudinal restraint strip, second longitudinal restraint strip, first diagonal restraint strip and second diagonal restraint strips and the aquatic sport performance garment material comprise the same materials.

In any one of the embodiments of the aquatic sport performance garment, any one of the first longitudinal restraint strip, second longitudinal restraint strip, first diagonal restraint strip and second diagonal restraint strips and the aquatic sport performance garment material comprise different materials.

In any one of the embodiments of the aquatic sport performance garment; any one or more of the first longitudinal restraint strip, second longitudinal restraint strip, first diagonal restraint strip and second diagonal restraint strips are affixed to or incorporated into an internal material surface of the aquatic sport performance garment; any one or more of the first longitudinal restraint strip, second longitudinal restraint strip, first diagonal restraint strip and second diagonal restraint strips are affixed to or incorporated into an external material surface of the aquatic sport performance garment; any one or more of the first longitudinal restraint strip, second longitudinal restraint strip, first diagonal restraint strip and second diagonal restraint strips are affixed to or incorporated into a material surface between layers of the aquatic sport performance garment; any one or more of the first longitudinal restraint strip, second longitudinal restraint strip, first diagonal restraint strip and second diagonal restraint strips are affixed to or incorporated into a material surface between internal panels of the aquatic sport performance garment; or any combination thereof.

In any one of the embodiments of the aquatic sport performance garment, the first diagonal restraint strip and the second diagonal restraint strip each comprise two or more materials, wherein each material comprises a different modulus of elasticity.

In any one of the embodiments of the aquatic sport performance garment, the first longitudinal restraint strip and the second longitudinal restraint strip each comprise two or more materials, wherein each material comprises a different modulus of elasticity.

In any one of the embodiments of the aquatic sport performance garment, the garment comprises; a wetsuit; a swimsuit; a body suit; a compression garment; or a combination thereof.

Provided herein is a wetsuit garment configured to inhibit side-to-side bending of a torso and encourage a rolling rotation of the torso of the user when the garment is worn, the garment having a first armpit region, a second armpit region, a first hip region, and a second hip region, the wetsuit comprising: a first longitudinal restraint strip comprising; a first end, a second end, and a first axis extending from the first end to the second end, wherein the first longitudinal restraint strip is affixed to a first material surface of a wetsuit material or is integrated into the wetsuit material, and is positioned such that the first axis is approximately parallel to a sagittal plane of a user when the wetsuit is worn, along a first lateral aspect of the wetsuit from the first armpit region to the first hip region; a second longitudinal restraint strip comprising; a third end, a fourth end, and a second axis extending from the third end to the fourth end, wherein the second longitudinal restraint strip is affixed to a second material surface of the wetsuit material or is integrated into the wetsuit material, and is positioned such that the second axis is approximately parallel to the sagittal plane along a second lateral aspect of the wetsuit from the second armpit region to the second hip region; a first crossing restraint strip comprising, a fifth end, a sixth end, and a third axis extending from the fifth end to the sixth end, wherein the first crossing restraint strip is affixed to a third material surface across a back region of the wetsuit material or is integrated into the wetsuit material, and is positioned diagonally such that the third axis is posteriorly offset from a coronal plane of the user when the wetsuit is worn, wherein the fifth end is positioned in contact with or in proximity to the first end of the first longitudinal restraint strip, and the sixth end is positioned in contact with or in proximity to the fourth end of the second longitudinal restraint strip; and a second crossing restraint strip comprising a seventh end, an eighth end, and a fourth axis extending from the seventh end to the eighth end wherein the second crossing restraint strip is affixed to the third material surface across the back region of the wetsuit material or is integrated into the wetsuit material, and is positioned diagonally such that the fourth axis is posteriorly offset from the coronal plane, wherein the seventh end is positioned in contact with or in proximity to the third end of the second longitudinal restraint strip, and the eighth end of the second diagonal restraint strip is positioned in contact with or in proximity to second end of the first longitudinal restraint strip, wherein the first crossing restraint strip and the second crossing restraint strip form an intersecting "X" pattern. In some embodiments, the first longitudinal restraint strip and the second longitudinal restraint strip have a first stiffness greater than a second stiffness of the wetsuit material to which it is affixed, and wherein the first or second material stiffness comprises an axial stiffness and/or a rotational stiffness. In some embodiments, the wetsuit further comprises: a first fixation point in contact with or in proximity to the first end of the first longitudinal restraint strip and the fifth end of the first crossing restraint strip; a second fixation point in contact with or in proximity to the seventh end of the second crossing restraint strip and the third end of the second longitudinal restraint strip; a third fixation point in contact with or in proximity to the second end of the first longitudinal restraint strip and the eighth end of the second crossing restraint strip; a fourth fixation point in contact with or in proximity to the sixth end of the first crossing restraint strip and the fourth end of the second longitudinal restraint strip; and a fifth fixation point at the intersection of the first crossing restraint strip and the second crossing restraint strip; wherein the first and second longitudinal restraint strips are essentially coupled to the first and second crossing restraint strips, wherein the first and second crossing restraint strips are essentially coupled to each other, and wherein the first fixation point, second fixation point, third fixation point, fourth fixation point and fifth fixation point are also affixed to a surface, or integrated into, the material of the wetsuit. In some embodiments, the first crossing restraint strip and the second crossing restraint strip further comprise a first modulus of elasticity greater than a second modulus of elasticity of the wetsuit material to which it is affixed. In some embodiments, the first crossing restraint strip and the second crossing restraint strip are configured to encourage a rolling rotation of the torso of the user's body when the wetsuit is worn by the user: by pulling the first hip region of the wetsuit (and hence the user's hip region) upward and toward the second armpit region, while causing second hip region to roll downward when a second arm is raised in front of or above the user's head, and by pulling the second hip region of the wetsuit (and hence the user's hip region) upward and toward the first armpit region while causing the first hip region to roll downward when a first arm is raised in front of or above the user's head. In some embodiments, the wetsuit material comprises: a rubber material; a nylon material; a rayon material; a polyurethane material; an elastic polyurethane material; a polyester material; or any combination thereof. In some embodiments, the first longitudinal restraint strip, second longitudinal restraint strip, first crossing restraint strip and second crossing restraint strips comprise: a rubber material; a textile material; a commercially pure titanium or titanium alloy; a commercially pure tantalum or tantalum alloy; a commercially pure copper or copper alloy; a silicone material; a neoprene material; a nylon material; a polypropylene material; a rayon material; a polyurethane material; an elastic polyurethane material; a polyester material; a Poly PBT material; a XLA material; or any combination thereof. In some embodiments, the first, second, third, fourth and fifth fixation points comprise: a glue; an epoxy; a rivet; a thread comprising: a polyester material, a nylon material, a cotton material, a silk material; a wool material, or a rayon material; an ultrasonic weld; or any combination thereof. In some embodiments, any one of the first longitudinal restraint strip, second longitudinal restraint strip, first crossing restraint strip and second crossing restraint strip and the wetsuit comprise the same materials. In some embodiments, any one of the first longitudinal restraint strip, second longitudinal restraint strip, first crossing restraint strip and second crossing restraint strips and the wetsuit comprise different materials. In some embodiments of the wetsuit; one or more of the first longitudinal restraint strip, second longitudinal restraint strip, first crossing restraint strip and second crossing restraint strips affixed to or incorporated into an internal material surface of the wetsuit; one or more of the first longitudinal restraint strip, second longitudinal restraint strip, first crossing restraint strip and second crossing restraint strips affixed to or incorporated into an external material surface of the wetsuit; one or more of the first longitudinal restraint strip, second longitudinal restraint strip, first crossing restraint strip and second crossing restraint strips affixed to or incorporated into a material surface between layers of the wetsuit; one or more of the first longitudinal restraint strip, second longitudinal restraint strip, first crossing restraint strip and second crossing restraint strips affixed to or incorporated into a material surface between internal panels of the wetsuit; or any combination thereof. In some embodiments of the wetsuit, a fixation medium between a surface of each of the first longitudinal restraint strip, second longitudinal restraint strip, first crossing restraint strip and second crossing restraint strips and an adjoining material surface of the wetsuit comprises: a glue comprising; a polyvinyl acetate, a polyurethane, a cyanoacrylates, a rubber glue, or a craft glue; an epoxy; a spray adhesive; an ultrasonic weld; or any combination thereof.

In any one of the embodiments of the aquatic sport performance garment or wetsuit, the first longitudinal restraint strip and second longitudinal restraint strip material comprises: a percentage of elongation within a range of about 10.0 percent in length; a percentage of elongation within a range of about 10.0 percent in width.

In any one of the embodiments of the aquatic sport performance garment or wetsuit, the first and second longitudinal restraint strips comprise: a stiffnesses within a range of about 5.0 percent to about 20 percent greater than the wetsuit material; a stiffnesses within a range of about 10.0 percent to about 20 percent greater than the wetsuit material; or a stiffnesses within a range of about 5.0 percent to about 40 percent greater than the wetsuit material.

In any one of the embodiments of the aquatic sport performance garment or wetsuit, the first and second crossing restraint strips comprise: a modulus of elasticity that is up to 50% greater than the wetsuit material; a modulus of elasticity that is up to 75% greater than the wetsuit material; or a modulus of elasticity that over 75% greater than the wetsuit material.

In some embodiments of either the aquatic sport performance garment or the wetsuit comprising first and second crossing restraints, or variations of the crossing restraints, the crossing restraint strips are further configured to mechanically connect a first shoulder region of the wetsuit on a first side of the user's body with a second hip region of the wetsuit on the second side of the user's body, and the second shoulder region of the wetsuit on the second side of the user's body with a first hip region of the wetsuit on the first side of the user's body.

In any one of the embodiments of the aquatic sport performance garment or wetsuit comprising first and second crossing restraints, or variations of the crossing restraints; when a user reaches and extends either arm over the head, a corresponding superior shoulder region of the wetsuit on the same side of the body as the extended arm causes an opposite hip region of the wetsuit to be pulled up and over, triggering a body roll rotation of the user toward the side of the extended arm of the user.

Provided herein is a wetsuit garment configured to inhibit side-to-side bending of a torso and encourage a rolling rotation of the torso of the user when the garment is worn, the garment having a first armpit region, a second armpit region, a first hip region, and a second hip region, the wetsuit comprising: a continuous "N" shaped, inverted (upside-down) "N" shaped or stylized "N" shaped first restraint strip comprising: a first unattached end on a first leg, a second unattached end on a third leg, and a second leg positioned diagonally and connecting the attached end of the first leg and attached end of the third leg in a continuous "N" pattern, wherein the first leg of the continuous "N" shaped, inverted "N" shaped or stylized "N" shaped restraint strip is affixed to a first material surface of a wetsuit material or is integrated into the wetsuit material, and is positioned such that the first leg is approximately parallel to a sagittal plane of a user when the wetsuit is worn, along a first lateral aspect of the wetsuit, from the first armpit region to the first hip region, wherein the third leg of the continuous "N" shaped, inverted "N" shaped or stylized "N" shaped restraint strip is affixed to a second material surface of the wetsuit material opposite the first material surface or is integrated into the wetsuit material, and is positioned such that the third leg is approximately parallel to the sagittal plane along a second lateral aspect of the aquatic sport performance garment from the second armpit region to the second hip region, and wherein the second diagonally positioned leg of the continuous "N" shaped, inverted "N" shaped or stylized "N" shaped restraint strip is affixed to a third material surface across a back region of the wetsuit material or is integrated into the wetsuit material, and is positioned such that the second leg is posteriorly offset from a coronal plane of the user when the garment is worn; a second restraint strip comprising: a third end, a fourth end, wherein the second restraint strip is affixed to the third material surface across a back region of the aquatic performance garment material or is integrated into the aquatic sport performance garment material, and is positioned diagonally such that the second restraint strip axis is posteriorly offset from a coronal plane of the user when the garment is worn, wherein the third end is positioned in contact with or in proximity to the first end of the first leg of the continuous "N" shaped, inverted "N" shaped or stylized "N" shaped restraint strip, and the fourth end is positioned in contact with or in proximity to the second end of the third leg of the continuous "N" shaped, inverted "N" shaped or stylized "N" shaped restraint strip, wherein the "N" shaped, inverted "N" shaped or stylized "N" shaped restraint strip and the second restraint strip form an "⋈" pattern.

Provided herein is a wetsuit garment configured to inhibit side-to-side bending of a torso and to encourage a rolling rotation of the torso of the user when the garment is worn, the garment having a first armpit region, a second armpit region, a first hip region, and a second hip region, the wetsuit comprising: a first longitudinal restraint strip comprising; a first end, a second end, and a first axis extending from the first end to the second end, wherein the first longitudinal restraint strip is affixed to a first material surface of a wetsuit material or is integrated into the wetsuit material, and is positioned such that the first axis is approximately parallel to a sagittal plane of a user when the wetsuit is worn, along a first lateral aspect of the wetsuit from the first armpit region to the first hip region; a second longitudinal restraint strip comprising; a third end, a fourth end, and a second axis extending from the third end to the fourth end, wherein the second longitudinal restraint strip is affixed to a second material surface of the wetsuit material or is integrated into the wetsuit material, and is positioned such that the second axis is approximately parallel to the sagittal plane along a second lateral aspect of the wetsuit from the second armpit region to the second hip region; a first "U"-shaped, "V"-shaped or stylized "U"-shaped restraint strip comprising: a fifth end; and a sixth end wherein the first "U"-shaped, "V"-shaped or stylized "U"-shaped restraint strip is positioned across a third posterior material surface such that the fifth end of the first "U"-shaped, "V"-shaped or stylized "U"-shaped restraint strip is in proximity to or connected to the first end of the first longitudinal restraint strip and the sixth end of the first "U"-shaped, "V"-shaped or stylized "U"-shaped restraint strip is in proximity to or connected to the third end of the second longitudinal restraint strip; and a second "U"-shaped, "V"-shaped or stylized "U"-shaped restraint strip comprising: a seventh end; and an eighth end; wherein the second "U"-shaped, "V"-shaped or stylized "U"-shaped restraint strip is positioned across the third posterior material surface such that the seventh end of the second "U"-shaped, "V"-shaped or stylized "U"-shaped restraint strip is in proximity to or connected to the second end of the first longitudinal restraint strip and the eighth end of the second "U"-shaped, "V"-shaped or stylized "U"-shaped restraint strip is in proximity to or connected to the fourth end of the second longitudinal restraint strip; wherein the first "U"-shaped, "V"-shaped or stylized "U"-shaped restraint strip and the second "U"-shaped, "V"-shaped or stylized "U"-shaped restraint strip are positioned in contact with or in proximity to each other at or about a first apex region of the first "U"-shaped, "V"-shaped or stylized "U"-shaped restraint strip and a second apex region of the second "U"-shaped, "V"-shaped or stylized "U"-shaped restraint strip, and wherein the first apex region and the second apex region intersect the sagittal plane of the third posterior material surface of the wetsuit forming a modified criss-cross pattern. In some embodiments, the wetsuit further comprises: a fixation point about the first apex of the first "U"-shaped, "V"-shaped or stylized "U"-shaped restraint strip and the second apex of the second "U"-shaped, "V"-shaped or stylized "U"-shaped restraint strip; wherein the first and second apex are essentially coupled to each other and to the wetsuit.

In some embodiments of the aquatic sports performance garment comprising alternate configurations of crossing restraint configurations the garments further comprises: a first fixation point in contact with or in proximity to the first end of the first longitudinal restraint strip and an end of one of the crossing restraint strips; a second fixation point in contact with or in proximity to the second end of the first longitudinal restraint strip and another end of one of the crossing restraint strips; a third fixation point in contact with or in proximity to the third end of the second longitudinal restraint strip and another end of one of the crossing restraint strips; a fourth fixation point in contact with or in proximity to the fourth end of the second longitudinal restraint strip and a last end of one of the crossing restraint strips; and a fifth fixation point at the intersection of the first crossing restraint strip and the second crossing restraint strip; wherein the first and second longitudinal restraint strips are essentially coupled to the first and second crossing restraint strips, wherein the first and second crossing restraint strips are essentially coupled to each other, and wherein the first fixation point, second fixation point, third fixation point, fourth fixation point and fifth fixation point are also affixed to a surface, or integrated into, the material of the aquatic sports performance garment.

Provided herein is a method of manufacturing a wetsuit having restraints comprising: patterning an upper body portion; patterning a lower-body portion; adjoining the lower-body portion to the upper body portion to form a full body wetsuit; patterning a first longitudinal restraint strip and a second longitudinal restraint strip, the first longitudinal restraint strip with a first end and a second end, the second longitudinal restraint strip with a third end and fourth end; patterning a first diagonal restraint strip and a second diagonal restraint strip, the first diagonal restraint strip with a fifth end and a sixth end, the second diagonal restraint strip with a seventh end and an eighth end, and restraining the wetsuit by; affixing the first longitudinal restraint strip from a first armpit region to a first hip region of a first lateral aspect of a material of the wetsuit, approximately parallel to a sagittal plane of a user when the wetsuit is worn, affixing the second longitudinal restraint strip from a second armpit region to a second hip region of a second lateral aspect of the material of the wetsuit, opposite the first lateral aspect, approximately parallel to a sagittal plane of a user when the wetsuit is worn, affixing the first diagonal restraint strip to a third material surface across a back region of the wetsuit material such that it is posteriorly offset from a coronal plane of the user when the garment is worn, and affixing the second diagonal restraint strip to the third material surface across the back region of the wetsuit material such that it is posteriorly offset from a coronal plane of the user when the garment is worn, wherein the fifth end of the first diagonal strip is positioned in contact with or in proximity to the first end of the first longitudinal restraint strip, and the sixth end is positioned in contact with or in proximity to the fourth end of the second longitudinal restraint strip; wherein the fifth end of the first diagonal strip is positioned in contact with or in proximity to the first end of the first longitudinal restraint strip, and the sixth end is positioned in contact with or in proximity to the fourth end of the second longitudinal restraint strip; wherein the seventh end of the second diagonal strip is positioned in contact with or in proximity to the third end of the second longitudinal restraint strip, and the eighth end is positioned in contact with or in proximity to the second end of the first longitudinal restraint strip, wherein the first diagonal restraint strip and the second diagonal restraint strip form an intersecting "X" pattern, and wherein each first longitudinal restraint strip, second longitudinal restraint strip, first diagonal restraint strip or second diagonal restraint strip is; affixed to or incorporated into an internal material surface of the wetsuit; affixed to or incorporated into an external material surface of the wetsuit; affixed to or incorporated between layers of the wetsuit; affixed to or incorporated between panels of the wetsuit; or any combination thereof. In some embodiments of the method, the restraints are affixed to or into the wetsuit or to each other using a sewn thread; compressive heat; a glue; an epoxy; a spray adhesive; an ultrasonic weld; or any combination thereof.

Provided herein is a method of reducing side-to-side hip bending and promoting a streamline profile of a swimmer's torso while swimming comprising: providing an aquatic garment to be worn by the swimmer having an upper body portion to cover a swimmer's upper torso and a lower-body portion, adjoining the upper body portion, to cover a portion of a swimmer's lower torso to at least an upper thigh region of a swimmer's legs; providing a first longitudinal restraint strip with a first end and a second end longitudinally affixed to or integrated into a first material surface along a first lateral aspect of the aquatic garment, wherein the first end is affixed in a first armpit region of the first lateral aspect and the second end is affixed in a first hip region of the first lateral aspect; providing a second longitudinal restraint strip with a third end and a fourth end affixed to or integrated into a second material surface along a second lateral aspect opposite the first lateral aspect, wherein the third end is positioned in a second armpit region of the second lateral aspect and the fourth end is positioned in a second hip region of the second lateral aspect; providing a first crossing restraint strip with a fifth end and a sixth end affixed to or integrated into a third material surface across the back of the aquatic garment, wherein the fifth end of the first crossing restraint strip is positioned in proximity to or in contact with the first end of the first longitudinal restraint strip and the sixth end of the first crossing restraint strip is positioned in proximity to or in contact with the fourth end of the second longitudinal restraint strip; and providing a second crossing restraint strip with a seventh end and a eighth end affixed to or integrated into the third material surface across the back of the aquatic garment, wherein the eighth end of the second crossing restraint strip is positioned in proximity to or in contact with the second end of the first longitudinal restraint strip and the seventh end of the second crossing restraint strip is positioned in proximity to or in contact with the third end of the second longitudinal restraint strip. In some embodiments, the method further comprises providing the first longitudinal restraint strip with a stiffness greater than the aquatic garment that resists lateral bending between a first fixation point in the first armpit region and a third fixation point in the first hip region, and providing the second longitudinal restraint strip with a stiffness greater than the aquatic garment that resists lateral bending between a second fixation point in the second armpit region and a fourth fixation point in the second hip region. In some embodiments, the method further comprises: providing the first crossing restraint strip with a third modulus of elasticity, less than a second modulus of elasticity of the aquatic garment, encouraging a twisting rotation about a longitudinal axis of the user's torso by pulling the first hip region on the first lateral side of the swimmer's body upward and over in a rolling motion toward the second armpit region while causing the second hip region do drop downward when a second arm is raised above and in front of the swimmer's head on the second lateral side; and providing the second crossing restraint strip with a third modulus of elasticity, less than a second modulus of elasticity of the aquatic garment, encouraging a twisting rotation about a longitudinal axis of the swimmer's torso by pulling the second hip region on the second lateral side of the swimmer's body upward and over in a rolling motion toward the first armpit region while causing the first hip region to drop downward when a first arm is raised above and in front of the swimmer's head on the first lateral side.

Provided herein is a restraint system configured to inhibit side-to-side bending of the torso of a user's body when the restraint system is utilized by the user while swimming, the restraint system comprising: a first longitudinal restraint strip comprising; a first end, a second end, and a first axis extending from the first end to the second end, wherein the first longitudinal restraint strip is affixable to a first surface of a human body first or a material surface an aquatic sport performance garment material or is integrated into the aquatic sport performance garment material, and is positioned such that the first axis is approximately parallel to a sagittal plane of the user or the garment when the garment is worn, along a first lateral aspect of the of the user's body or along a first lateral aspect of the aquatic sport performance garment, from a first armpit region to a first hip region; and a second longitudinal restraint strip comprising; a third end, a fourth end, and a second axis extending from the third end to the fourth end, wherein the second longitudinal restraint strip is affixable to a second surface of a human body or a second material surface of the aquatic sport performance garment material or is integrated into the aquatic sport performance garment material, and is positioned such that the second axis is approximately parallel to the sagittal plane of the user or the garment when the garment is worn, along a second lateral aspect of the of the user's body or the aquatic sport performance garment from a second armpit region to a second hip region. In some embodiments, the restraint system is further configured to encourage a rolling rotation of the torso of the user and further comprises: a first crossing restraint strip comprising, a fifth end, a sixth end, wherein the first crossing restraint strip is affixable to a back of a user or a third material surface across a back region of the aquatic performance garment material or is integrated into the aquatic sport performance garment material, and is positioned diagonally such that the first crossing restraint strip is posteriorly offset from a coronal plane of the user or the garment when the garment is worn, wherein the fifth end is positioned in contact with or in proximity to the first end of the first longitudinal restraint strip, and the sixth end is positioned in contact with or in proximity to the fourth end of the second longitudinal restraint strip; and a second crossing restraint strip comprising a seventh end, an eighth end, wherein the second crossing restraint strip is affixable to the back of the user or the third material surface across the back region of the aquatic performance garment material or is integrated into the aquatic sport performance garment material, and is positioned diagonally such that the second crossing restraint strip is posteriorly offset from the coronal plane of the user or the garment when the garment is worn, wherein the seventh end is positioned in contact with or in proximity to the third end of the second longitudinal restraint strip, and the eighth end of the second crossing restraint strip is positioned in contact with or in proximity to the second end of the first longitudinal restraint strip, wherein the first crossing restraint strip and the second crossing restraint strip form an intersecting "X" pattern when assembled and affixed. In some embodiments, the first crossing restraint strip and the second crossing restraint strip are configured to encourage a rolling rotation of the torso of the user when affixed to the user or when the garment is worn.

Provided herein is a restraint system configured to inhibit side-to-side bending of the torso of a user's body and to encourage a rolling rotation of the torso of the user's body when the restraint system is utilized by the user while swimming, the restraint system comprising: a continuous "N" shaped, inverted (upside-down) "N" shaped or stylized "N" shaped first restraint strip comprising: a first unattached end on a first leg, a second unattached end on a third leg, and a second leg positioned diagonally and connecting the attached end of the first leg and attached end of the third leg in a continuous "N" pattern, wherein the first leg of the continuous "N" shaped, inverted "N" shaped or stylized "N" shaped restraint strip is affixable to a human body or to a material surface of an aquatic sports performance garment material or is integrated into the aquatic sports performance garment material, and is positioned such that the first leg is approximately parallel to a sagittal plane of a user or the aquatic sports performance garment, when the garment is worn, along a first lateral aspect of the user or the aquatic sports performance garment, from a first armpit region to a first hip region, wherein the third leg of the continuous "N" shaped, inverted "N" shaped or stylized "N" shaped restraint strip is affixable to the user or a second material surface of the aquatic sports performance garment material opposite the first material surface or is integrated into the aquatic sports performance garment material, and is positioned such that the third leg is approximately parallel to the sagittal plane along a second lateral aspect of the user or the aquatic sport performance garment from a second armpit region to a second hip region, and wherein the second diagonally positioned leg of the continuous "N" shaped, inverted "N" shaped or stylized "N" shaped restraint strip is affixable to a back of the user or a third material surface across a back region of the aquatic sports performance garment material or is integrated into the aquatic sports performance garment material, and is positioned such that the second leg is posteriorly offset from a coronal plane of the user or the garment, when the garment is worn; a second restraint strip comprising: a third end and a fourth end, wherein the second restraint strip is affixable to the back of the user or the third material surface across a back region of the aquatic performance garment material or is integrated into the aquatic sport performance garment material, and is positioned diagonally such that the second restraint strip axis is posteriorly offset from a coronal plane of the user or the garment, when the garment is worn, wherein the third end is positioned in contact with or in proximity to the first end of the first leg of the continuous "N" shaped, inverted "N" shaped or stylized "N" shaped restraint strip, and the fourth end is positioned in contact with or in proximity to the second end of the third leg of the continuous "N" shaped, inverted "N" shaped or stylized "N" shaped restraint strip, wherein the "N" shaped, inverted "N" shaped or stylized "N" shaped restraint strip and the second restraint strip form an "⋈" pattern when assembled and affixed.

Provided herein is a restraint system configured to inhibit side-to-side bending of the torso of a user's body when the restraint system is utilized by the user while swimming, the restraint system comprising: a first longitudinal restraint strip comprising; a first end, a second end, and a first axis extending from the first end to the second end, wherein the first longitudinal restraint strip is affixable to a human body or to a first material surface of an aquatic sports performance garment material or is integrated into the aquatic sports performance garment material, and is positioned such that the first axis is approximately parallel to a sagittal plane of a user or the garment when the aquatic sports performance garment is worn, along a first lateral aspect of the body or the aquatic sports performance garment from a first armpit region to a first hip region; a second longitudinal restraint strip comprising; a third end, a fourth end, and a second axis extending from the third end to the fourth end, wherein the second longitudinal restraint strip is affixable to a second surface of the body or a second material surface or the aquatic sports performance garment or is integrated into the aquatic sports performance garment material, and is positioned such that the second axis is approximately parallel to the sagittal plane along a second lateral aspect of the body or the aquatic sports performance garment, from a second armpit region to a second hip region. In some embodiments, the restraint system is further configured to encourage a rolling rotation of the torso of the user and further comprises: a first "U"-shaped, "V"-shaped or stylized "U"-shaped restraint strip comprising: a fifth end; and a sixth end wherein the first "U"-shaped, "V"-shaped or stylized "U"-shaped restraint strip is positionable across the back of the user or a third posterior material surface of the garment such that the fifth end of the first "U"-shaped, "V"-shaped or stylized "U"-shaped restraint strip is in proximity to or connected to the first end of the first longitudinal restraint strip and the sixth end of the first "U"-shaped, "V"-shaped or stylized "U"-shaped restraint strip is in proximity to or connected to the third end of the second longitudinal restraint strip; and a second "U"-shaped, "V"-shaped or stylized "U"-shaped restraint strip comprising: a seventh end; and an eighth end; wherein the second "U"-shaped, "V"-shaped or stylized "U"-shaped restraint strip is positionable across the back of the user or the third posterior material surface of the garment such that the seventh end of the second "U"-shaped, "V"-shaped or stylized "U"-shaped restraint strip is in proximity to or connected to the second end of the first longitudinal restraint strip and the eighth end of the second "U"-shaped, "V"-shaped or stylized "U"-shaped restraint strip is in proximity to or connected to the fourth end of the second longitudinal restraint strip; wherein the first "U"-shaped, "V"-shaped or stylized "U"-shaped restraint strip and the second "U"-shaped, "V"-shaped or stylized "U"-shaped restraint strip are positionable in contact with or in proximity to each other at or about a first apex region of the first "U"-shaped, "V"-shaped or stylized "U"-shaped restraint strip and a second apex region of the second "U"-shaped, "V"-shaped or stylized "U"-shaped restraint strip, and wherein the first apex region and the second apex region intersect the sagittal plane of the user at the user's back or at the third posterior material surface of the aquatic sports performance garment, forming a modified criss-cross pattern, such as one of the following patterns; "⋈", "⋈", "⋈" or "⋈".

Provided herein is a method of manufacturing a restraint system configured to reduce side-to-side bending of the torso of a user's body when the restraint system is utilized by the user while swimming, the method comprising: patterning a first restraint strip having a first end and a second end and affixable to a first lateral aspect of user's body or a corresponding first lateral material surface of an aquatic garment; and patterning a second restraint strip having a third end and a fourth end and affixable to a second lateral aspect of the user's body or a corresponding second lateral material surface of the aquatic garment; providing a fixation medium affixable to a surface of each of the first and second restraint strips capable of adhering at least temporarily to the skin of the user or a material surface of the aquatic garment; providing instructions for application of the first and second restraint strip to the user's body or the aquatic garment; wherein the first end of the first restraint strip is positionable at or about a first armpit region of the first lateral aspect of the user's body or garment, the second end of the first restraint strip is positionable at or about a first hip region of the first lateral aspect of the user's body or garment, the third end of the second restraint strip is positionable in a second armpit region of the second lateral aspect of the user's body or garment, and the fourth end of the second restraint strip is positioned in a second hip region of the second lateral aspect of the user's body or garment. In some embodiments of the method of manufacturing a restraint system, the restraint system is further configured to encourage a rolling rotation of the torso of the user and the method further comprises: patterning a first crossing restraint strip having a fifth end and a sixth end and affixable across the back of the user's body or a posterior material surface of the aquatic garment; patterning a second crossing restraint strip having a seventh end and an eighth end and affixable across the back of the user's body or the posterior material surface of the aquatic garment; providing a fixation medium affixable to a surface of each first and second crossing restraint strip capable of adhering at least temporarily to the skin of the user or the material surface of the aquatic garment; providing instructions for application of the first and second crossing restraint strip to the user's body or the aquatic garment; wherein the fifth end of the first crossing restraint strip is positioned in proximity to or in contact with the first end of the first restraint strip and the sixth end of the first crossing restraint strip is positioned in proximity to or in contact with the fourth end of the second restraint strip; wherein the seventh end of the second crossing restraint strip is positioned in proximity to or in contact with the third end of the second restraint strip and the eighth end of the second crossing restraint strip is positioned in proximity to or in contact with the second end of the first restraint strip, and wherein the application of the first and second crossing restraint strips across the back of the user's body or the back of the aquatic garment worn by the user improve overall swimming mechanics by encouraging coordinated hip and shoulder movements when swimming when the restraint system is applied to the skin of the user or the aquatic garment comprising the restraint system is worn by the user. In some embodiments of the method, a thickness of any one of the restraint strips is in a range from about 0.05 mm to about 8.00 mm. In some embodiments of the method, the application of the restraint system to the user's body or the aquatic garment when worn by the user, cause the user's body to maintain a straighter longitudinal body profile and reduced longitudinal drag when swimming. In some embodiments of the method, any one of the restraint strips further comprises widths in a range of about 0.1 cm to about 16.0 cm; and further comprises lengths in a range from about 5.0 cm to about 90.0 cm. In some embodiments of the method, each restraint strip is: affixable to the skin of the user's body; affixable to an internal material surface of the aquatic garment; or affixable to an external material surface of the aquatic garment.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
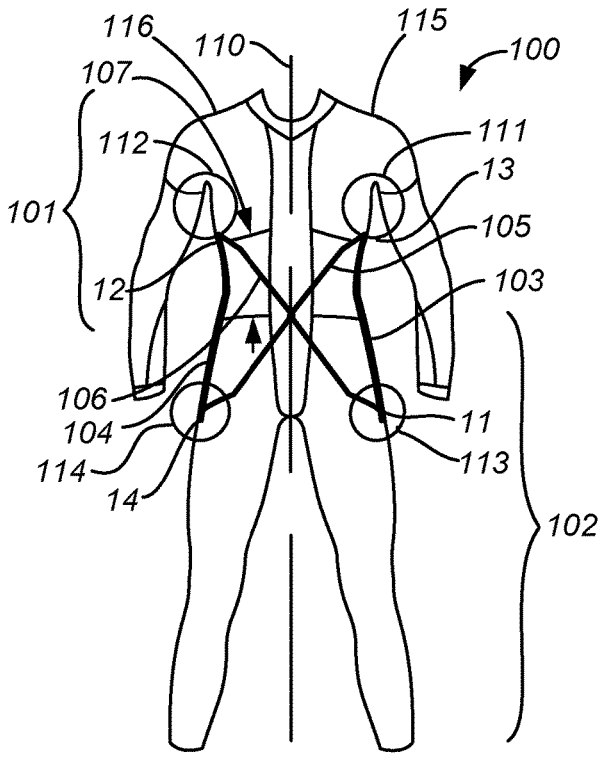
FIG. 1 is a back view of an illustrative embodiment of a sports performance garment or wetsuit illustrating representative positioning of restraints in accordance with the teachings herein.

While existing wetsuits are suitable for their intended purpose, further improvements in the art are possible. This is especially true with respect to performance wetsuits that are designed for use in swimming and triathlon events, since even small improvements in such a sports performance garments or wetsuits can make the difference between success and failure for the wearer. This point is illustrated by the fact that some recent Ironman triathlons have been decided by a few seconds, even though these competitions typically last more than 8 hours. For example, the 2012 Ironman Cozumel triathlon's female race was won by seven seconds, after a total elapsed time of nine hours and fifteen minutes.

One area requiring improvement in wetsuits, especially those designed for swimmers, relates to the density, stiffness and thickness of the materials (typically neoprene) used in their construction. In particular, some wetsuits do not impart optimal buoyancy to the wearer, due to the density and thickness of the neoprene used in their construction. This causes the wearer to ride lower in the water, thus reducing swimming speeds and increasing energy expenditure. In some cases, sub-optimal buoyancy placement may also cause the swimmer to ride too high in the water in the chest region. This causes the legs to drop, thus resulting once again in a sub-optimal net body position.

Other wetsuits are too thick in some areas and subsequently too stiff, resulting in the overheating and general strain of various muscle groups, causing premature fatigue. Alternatively, some wetsuits are not stiff enough in other areas, resulting in failure to properly support skeletal structures or appropriately activate core muscle groups necessary to provide the extra lift a swimmer needs to improve buoyancy, improve net body position in the water, promote proper swimming mechanics, or encourage optimal rotation of the body along the longitudinal axis, all of which can affect the user's endurance.

Other wetsuits incorporate lower density neoprene in a bid to improve buoyancy. However, the density distribution in such wetsuits is typically also sub-optimal, leading to increased heat retention and resistance to proper swimming mechanics. For example, such designs often incorporate lower density materials in the arms and hip regions of the wetsuit, which may inhibit proper rotation of the swimmer's body along its longitudinal axis (roll). Similarly, such designs also often fail to ensure optimal body position along a lateral axis (pitch).

It has now been found that many of the foregoing issues are addressable through modified construction of a wetsuit using strategically placed restraints. The addition of appropriately configured lateral restraints used in a sports performance garment or wetsuit can help activate key muscles of the lateral core to provide optimal benefits. In particular, properly configured longitudinal lateral restraining strips, applied between the armpit or rib cage and hip, connect the upper back and shoulder region on one side of the body with the top of the hip region on the same side of the body. In particular, the placement, density and/or thickness of the restraints may be varied to optimize the skeletal mechanics of a swimmer by, for example, making the lateral portion of the wetsuit stiffer to reduce or minimize side-side bending about the waist will minimize "wiggle" or "hip yaw" and improve overall "torso and body yaw" along the longitudinal axis, as well as generally improving body position along the longitudinal axis (pitch) of the swimmer. Additionally, extra skeletal and core muscle support can be achieved with the addition of cross-stiffening restraints that activate appropriate core muscle structures and tie the hip complex on one side of a side with the opposing shoulder complex of a swimmer to improve "roll" mechanics, particularly when swimming crawl (and/or backstroke).

Current triathlon and open-water swimming wetsuits provide nearly zero core stability laterally, and they do little to help with rotation. In fact, most triathletes are novice freestyle (also commonly known as the front crawl stroke) swimmers, resulting in a poor understanding of proper body position and rotation. As a result, many triathlon and open-water swimmers suffer from a debilitating hip "wiggle" while they swim. This wiggle occurs when the swimmer bends sideways at the waist rather than properly rotating the hips around.

The front crawl, is considered the fastest and most efficient of the competitive swimming strokes. It is almost always used in the freestyle event of swimming competitions and is also often the preferred stroke of experienced swimmers and triathletes. However, in some competitive swimming events, the term "freestyle" also means "swimmer's choice", meaning the swimmer can elect to use another stroke, or a modified version of any stroke, instead of the "front crawl". For example, depending on the athlete, the swimming conditions and/or the distance of the competition, a swimmer may elect to swim another stroke, such as backstroke, breaststroke or butterfly, for example. In some cases, a swimmer may specialize in another stroke and feel they can swim one of these other strokes faster or more efficiently than the front crawl.

The "wiggle" bending from side-to-side creates very poor stroke mechanics and extra drag in the water. The swimmer is flat and shorter in the water. Further, the swimmer is not properly physiologically connecting the shoulders and hips while they rotate during rotary breathing. A properly rotating swimmer slices through the water more hydro-dynamically, and the swimmer is "taller" allowing him/her to reach further and grab more water (a few inches) with each arm stroke.

Additionally, many triathlon and open-water swimming wetsuits do little to compress around the core of the body of a user. Strategic compression to stabilize the core has been proven to improve buoyancy/lift in the water, while also decreasing lactate acid levels. While many triathlon and open-water swimming wetsuit designs use materials such as neoprene to provide muscle warmth and limited amounts of compression, often in debilitating locations, not enough compression has been applied in key areas for optimal benefit. The addition of appropriately configured cross-stiffening restraints used in a wetsuit can help activate key muscles of the core to provide optimal benefits. In particular, properly configured cross stiffening strips, applied across the back, connect the back shoulder region on one side of the body with the top of the hip region on the other side of the body. As the swimmer reaches and extends with the shoulder complex, the opposite hip is pulled up, triggering a body roll rotation. The resulting body mechanics encourage proper rotation of the muscle and skeletal structures along the longitudinal axis of the body. Additionally, the stiffening strips provide more compression than the surrounding neoprene, strategically compressing the back core area while simultaneously activating the abdominal core structures. This extra compression has been shown to provide the extra lift a swimmer needs to enhance buoyancy and endurance. In summary, the vertical strips inhibit side-to-side bending about the waist by activating lateral core muscle structures, resulting in a more streamlined, longitudinal profile in the water, while the cross-strips connect the opposite sides of the body, encouraging rotation and back core muscle compression and abdominal core muscle activation. Together the strips work as a unit to appropriately activate the core muscles, providing extra lift (improved pitch), improved streamline profile (less yaw), proper rotation (more roll) and resulting endurance benefits.

This approach has the effect of enhancing proper swim mechanics, including the proper rotation of the user's body along its longitudinal axis. This enhancement is of particular value, because proper swimming technique requires rotation of up to 40 degrees in each direction on the longitudinal axis. Similarly, the proper alignment along the lateral axis (pitch) leads to a reduction of form drag. Hence, this approach helps to optimize buoyancy for the swimmer along the latitudinal axis, while simultaneously facilitating proper rotation along the longitudinal axis.

As used herein, the terms "comprises", "comprising", or any other variations thereof, are intended to cover a nonexclusive inclusion, such that a process, method, article, or apparatus that comprises a list of elements does not include only those elements but may include other elements not expressly listed or inherent to such process, method, article, or apparatus.

As used herein, the term "restraint" or "restraint strip" means a component, material or material condition that influences and limits or restricts the movement of an aquatic sports performance garment or the torso of a user using such garments or restraints. A restraint can be fabricated from the same material as the sports performance garment or wetsuit, or from an entirely different material or combination of materials. As described herein, a restraint may take many forms including, but not limited to: a strip (as in a strip of material or tape), a reinforced seam, a panel section, a cord or rope, to name but a few.

It is understood by one skilled in the art that materials and material conditions may be altered or manipulated to provide varying desirable characteristics, or conversely, to eliminate undesirable characteristics. These characteristics or material properties can include, but are not limited to, thickness, direction off stretch, elasticity, modulus of elasticity, creep, fatigue, flexural strength, rotational strength and/or tensile strength depending on the homogeneity of the material, bending modulus, resilience, shear strength, stiffness and toughness, among other physical and/or chemical properties.

As used herein, and unless otherwise specified, the term "anterior" refers to human anatomy and means the front surface of the body; often used to indicate the position of one structure relative to another, that is, situated nearer the front part of the body. Alternately, it may also refer in a similar fashion to an apparatus or structure.

As used herein, and unless otherwise specified, the term "posterior" refers to human anatomy and means the back surface of the body; Often used to indicate the position of one structure relative to another, that is, nearer the back of the body. Alternately, it may also refer in a similar fashion to an apparatus or structure.

As used herein, and unless otherwise specified, the term "superior" refers to human anatomy and means situated nearer the vertex of the head in relation to a specific reference point; opposite of inferior. It may also mean situated above or directed upward. Alternately, it may also refer in a similar fashion to an apparatus or structure.

As used herein, and unless otherwise specified, the term "inferior" refers to human anatomy and means situated nearer the soles of the feet in relation to a specific reference point; opposite of superior. It may also mean situated below or directed downward. Alternately, it may also refer in a similar fashion to an apparatus or structure.

As used herein, and unless otherwise specified, the term "medial" generally refers to orientations of human anatomy and means denoting a position situated toward the median plane or midline of the body. Alternately, it may also refer in a similar fashion to an apparatus or structure.

As used herein, and unless otherwise specified, the term "lateral" refers to orientations of human anatomy and means denoting a position farther from the median plane or midline of the body or a structure. It may also mean "pertaining to a side". Alternately, it may also refer in a similar fashion to an apparatus or structure.

As used herein, and unless otherwise specified, the term "transverse plane", (also called the horizontal plane, axial plane, or transaxial plane) is an imaginary plane that divides the body into superior and inferior parts at the shoulders and is perpendicular to the coronal and sagittal planes.

As used herein, and unless otherwise specified, the term "coronal plane", (also known as the frontal plane, sometimes referred to as a longitudinal plane because it is perpendicular to the transverse plane) is any vertical plane that divides the body into ventral and dorsal (belly and back) sections.

As used herein, and unless otherwise specified, the term "sagittal plane", (also known as median plane or mid-sagittal plane) is an anatomical plane which divides the body into right and left halves. This plane cuts the body into halves (assuming bilateral symmetry), passing through mid-line structures such as the navel and spine. The term parasagittal is used to describe any plane parallel to the sagittal plane.

As used herein, the term "proximity" means nearness in space or relationship, but not excluding the potential to be touching. Proximity is also alternatively meant to mean that one thing may be as close to another thing as to be "in direct or nearly direct contact" (in proximity) with another thing along some point. Proximity is also alternatively meant to mean that a first thing is within about 2.0 cm, within about 4.0 cm, within about 6.0 cm, within about 8.0 cm, or within about 10.0 cm to a second thing. To "place something in proximity" is also meant to mean that items are "paired" or "mated together" either in their paired function, nearly in contact and functioning in unison, or at some point of contact.

As used herein, and unless otherwise specified, the term "about" or "approximately" means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 mm, 30.0 mm, 20.0 mm, 10.0 mm 5.0 mm 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 20.0 degrees, 15.0 degrees, 10.0 degrees, 9.0 degrees, 8.0 degrees, 7.0 degrees, 6.0 degrees, 5.0 degrees, 4.0 degrees, 3.0 degrees, 2.0 degrees, 1.0 degrees, 0.9 degrees, 0.8 degrees, 0.7 degrees, 0.6 degrees, 0.5 degrees, 0.4 degrees, 0.3 degrees, 0.2 degrees, 0.1 degrees, 0.09 degrees. 0.08 degrees, 0.07 degrees, 0.06 degrees, 0.05 degrees, 0.04 degrees, 0.03 degrees, 0.02 degrees or 0.01 degrees of a given value or range.

As used herein, the term "neoprene" refers to a synthetic rubber made by the polymerization of chloroprene, characterized by superior resistance (as to oils), and used especially for special-purpose clothing (i.e. as gloves, aquatic sports performance garment and wetsuits).

As used herein, the term "aerated neoprene" refers to a type of neoprene which comprises multiple laminated layers, at least one of which is perforated and cut such that the final product is a sealed neoprene with individual pockets of air trapped inside the neoprene layers.

As used herein, the terms aquatic sports performance garment, aquatic garment, wetsuit and similar terms are used interchangeably and refer to any garment configured for and intended to enhance the performance of athletes involved in sports incorporating aquatic events including triathlon garments, aquatic compression garments, body suits and other swimwear. These garments provide drag reduction in the form of faster-than-skin surface coatings, warmth and additional buoyancy to the wearer, and are designed to enhance the speed and ease with which the wearer moves through the water while swimming.

As used herein, the term "musculoskeletal complex" refers to a combination of the muscular and skeletal systems working together and includes the bones, muscles, tendons and ligaments of the body. For example: a shoulder musculoskeletal complex means the bones, muscles, tendons and ligaments of the shoulder region of the body. As a further example: a hip musculoskeletal complex means the bones, muscles, tendons and ligaments of the hip region of the body.

As used herein, the terms "affix", "affixed", "affixable", "fix" or "fixed" means to attach, append, bind, join, integrate, add or fasten (something) to something else. This may be accomplished in a large number of ways including various types of fixation mediums such as glues, or epoxies (meant for either temporary or permanent fixation), including pastes and gum materials. Alternatively, an item may be affixed to something by means of sewing them together with a threading material. Still further, other types of attachment include various material welding techniques such as ultrasonic welding—an industrial technique whereby high-frequency ultrasonic acoustic vibrations are locally applied to work pieces being held together under pressure to create a solid-state weld. It is commonly used for plastics, various rubbers and polymers (i.e. neoprene, nylon, polyester, polypropylene, polyurethanes, etc.), and especially for joining dissimilar materials. In ultrasonic welding, there are no connective threads, bolts, nails, staples, rivets, soldering materials, or adhesives necessary to bind the materials together. However, it is understood by one skilled in the art that the ultrasonic weld itself is a consolidation of two materials (the same or different) that have been welded or integrated together (melted together using high-frequency sound waves and pressure), creating a composite between the joined layers. One of skill in the art will recognize that the aforementioned definitions and means of attachment are not all-inclusive and would further understand that there are many alternative means for attaching or affixing two or more things such as similar and dissimilar fabrics and/or layered materials together.

As used herein the term "stiffness" means the rigidity of an object or material, or the extent to which an object or material resists deformation in response to an applied force. Said another way, stiffness is the resistance of an elastic body to deflection or deformation by an applied force. The stiffness, k, of a body is a measure of the resistance offered by an elastic body to deformation. For an elastic body with a single degree of freedom (DOF) (for example, stretching or compression of a rod), the stiffness k (N/m, lb./in) is defined as $$k = \frac{F}{\delta},$$

where, F is the force (N, lb.) applied on the body and δ (m, in) is the displacement produced by the force along the same degree of freedom (for instance, the change in length of a stretched spring). In the International System of Units, stiffness is typically measured in Newtons per meter (N/m). In Imperial units, stiffness is typically measured in pounds per inch (lb./in).

The complementary concept to stiffness is flexibility or pliability: the more flexible an object is, the less stiff it is. As used herein, "flexibility" means the quality of bending easily without breaking.

The inverse of stiffness is compliance (or sometimes elastic modulus), typically measured in units of meters per newton.

As used herein "rotational stiffness" is defined as k, given by $$k = \frac{M}{\theta},$$

where M is the applied moment θ is the rotation. In the SI system, rotational stiffness is typically measured in newton-meters per radian. In the SAE system, rotational stiffness is typically measured in inch-pounds per degree.

As used herein "elasticity" means the ability of an object or material to resume its normal shape after being stretched or compressed; stretchiness. In general, elastic modulus is not the same as stiffness. Elastic modulus is a property of the constituent material; stiffness is a property of a structure. That is, the modulus is an intensive property of the material; stiffness, on the other hand, is an extensive property of the solid body dependent on the material and the shape and boundary conditions. For example, for an element in tension or compression, the axial stiffness is $$k = \frac{AE}{L},$$

where A is the cross-sectional area, E is the (tensile) elastic modulus (or Young's modulus), and L is the length of the element.

Similarly, the rotational stiffness of a straight section is $$k = \frac{GJ}{L},$$

where "J" is the torsion constant for the section, "G" is the rigidity modulus of the material, Note that in SI, these units yield $$k: \frac{N \cdot m}{\text{rad}}.$$

For the special case of unconstrained uniaxial tension or compression, Young's modulus can be thought of as a measure of the stiffness of a material.

The stiffness of a structure is of principal importance in many engineering applications, so the modulus of elasticity is often one of the primary properties considered when selecting a material. A high modulus of elasticity is sought when deflection is undesirable, while a low modulus of elasticity is required when flexibility is needed.

In summary: Young's modulus measures the resistance of a material to elastic. (recoverable) deformation under load. A stiff material has a high Young's modulus and changes its shape only slightly under elastic loads (e.g. diamond). A flexible material has a low Young's modulus and changes its shape considerably (e.g. rubbers). Elasticity is the tendency of solid materials to return to their original shape after forces are applied on them. When the forces are removed, the object will return to its initial shape and size if the material is elastic. Stiffness is the rigidity of an object the extent to which it resists deformation in response to an applied force. The complementary concept of stiffness is flexibility or pliability; the more flexible an object is, the less stiff it is. Relative stiffness of a material is the property that allows something to resist bending, stretching, twisting or other deformation under a load. It is function of the material's modulus of elasticity (see Young's modulus) and shape.

As used herein, the terms "pitch", "roll" and "yaw", have similar meanings to the terms used to describe control of an aircraft in flight or a submarine in water. In many respects the movements of a swimmer in water are very similar. Stability and control of the swimmers body is similarly complex because a change in one of the three types of movement will likely affect the other two. As used herein, consider three lines or axes running through a swimmer's body and intersecting at right angles at the swimmer's center of gravity, which also relate to corresponding planes of intersection. A longitudinal axis is a line drawn down the center of the standing body from the center of the head, through the torso and to the ground between the legs. A transverse axis is a line drawn from a first lateral side through to the opposite (second) lateral side, typically at or about the upper hip region or illiac crest, at the approximate center of gravity of the body and intersecting the longitudinal (and frontal) axis. A frontal axis is a line drawn from anterior to posterior sides of the body, at the approximate center of gravity of the body and intersecting the longitudinal (and transverse) axis. Corresponding planes of intersection are the Sagittal, Coronal and Transverse plane. The Sagittal plane is a plane that divides a body equally into left and right halves from head to toe. A Coronal plane is a plane that divides a body into front (anterior) and back (posterior) halves. The Sagittal and Coronal planes intersect along the longitudinal axis. The Transverse plane is a plane that divides the body into superior (upper) and inferior (lower) halves at or about the center of gravity of the body. The Transverse plane intersects the body along the transverse and frontal axes.

As used herein, "roll" refers to rotation of the swimmer's torso or body about the longitudinal axis, wherein the Coronal and Sagittal planes rotate or twist, but not necessarily in equal amounts over their entire respective planes.

As used herein, "pitch" refers the angle of inclination of the body in the water from head to toe along the longitudinal axis, wherein the Coronal plane tilts about the transverse axis, but not necessarily evenly (stiffly) over the entire plane. When the head is higher than the feet in the water, the pitch is inclined when the head and feet are level in the water the pitch is horizontal, etc.

As used herein, "yaw" can have the same or a modified meaning to the typical aeronautical or mariner usage. Herein, "yaw" refers to the side to side (lateral) bending of the swimmer's torso about the waist ("wiggle"), wherein the hips tend to shift along the transverse axis and at the approximate intersection of the Transverse and Coronal planes, causing the torso to bend (laterally) and shift the approximate center of gravity (the intersection of the longitudinal, frontal and transverse axes).

When a swimmer has poor form and inadequate "roll" in their crawl stroke, the hips will "yaw", or jut out, in a direction opposite the side of the body with an arm raised over the head. However, when a swimmer has good form, with appropriate "roll" in their crawl stroke the hips maintain their proper alignment, and the entire torso and legs maintain a straighter line along the longitudinal axis and minimize the overall body "yaw", (from head to toes), thus maintaining near zero yaw, as it is typically understood in typical aeronautical or mariner usage.

As used herein, "torso", means the trunk of the human body, a wetsuit or similar aquatic sports performance garment to at least the crotch region, without the head and arms, but optionally including the upper to mid-thigh region of the legs.

As used herein, the term "core" refers to the muscular structure of the central torso of a person. The major muscles of the core reside in the area of the belly, the mid- and lower back, and peripherally include the hips, the shoulders and to some extent, the neck region. Major muscles of the core include: the pelvic floor muscles, transversus abdominis, multifidus, internal and external obliques, rectus abdominis, erector spinae (sacrospinalis) especially the longissimus thoracis, and the diaphragm. Minor core muscles include the latissimus dorsi, gluteus maximus, and trapezius.

As used herein, "the body", refers to the entire human body, a wetsuit or similar aquatic sports performance garment, including the arms and legs, (without the hands or feet) and optionally including the head.

Provided herein is an aquatic sport performance garment configured to inhibit side-to-side bending of a torso of a user when the garment is worn, the garment having a first armpit region, a second armpit region, a first hip region, and a second hip region, the garment comprising: a first longitudinal restraint strip comprising; a first end, a second end, and a first axis extending from the first end to the second end, wherein the first longitudinal restraint strip is affixed to a first material surface of an aquatic performance garment material or is integrated into the aquatic sport performance garment material, and is positioned such that the first axis is approximately parallel to a sagittal plane of a user when the garment is worn along a first lateral aspect of the aquatic sport performance garment from the first armpit region to the first hip region; and a second longitudinal restraint strip comprising; a third end, a fourth end, and a second axis extending from the third end to the fourth end, wherein the second longitudinal restraint strip is affixed to a second material surface of the aquatic performance garment material or is integrated into the aquatic sport performance garment material, and is positioned such that the second axis is approximately parallel to the sagittal plane along a second lateral aspect of the aquatic sport performance garment from the second armpit region to the second hip region.

Figure 2:
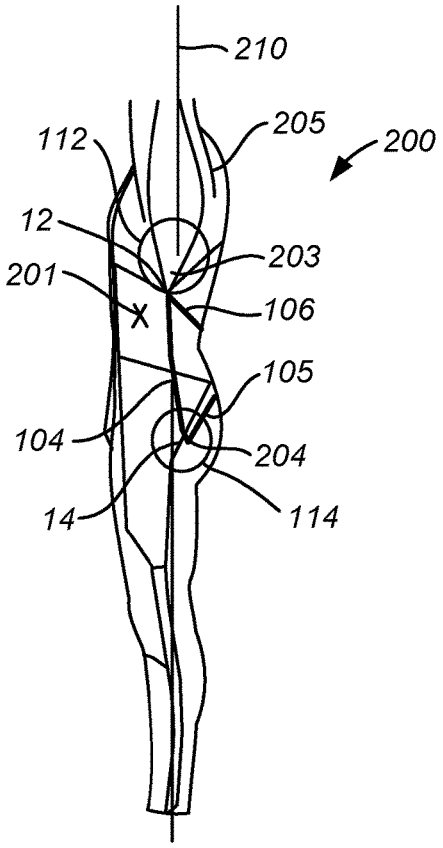
FIG. 2 is a left side view of an illustrative embodiment of a sports performance garment or wetsuit with the arms raised above the head illustrating representative positioning of restraints in accordance with the teachings herein.
Figure 3A:
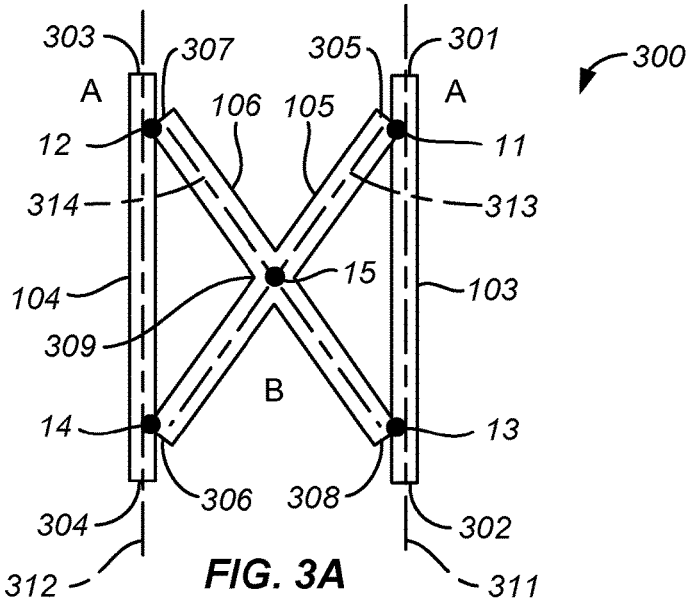
FIG. 3A is a simplified representative illustration of a one variant of a restraint system showing the potential interaction between the longitudinal restraints "|" and the crossing restraints "X" forming a "|X|" pattern.

As illustrated in FIGS. 1, 2 and 3A, the aquatic sport performance garment is configured to inhibit side-to-side bending of the torso of a user's body when the wetsuit is worn by the user while swimming, the garment comprising: a first longitudinal restraint strip 103 having a first end 301 and a second end 302 and a first axis 311 extending from the first end 301 to the second end 302, affixed to or integrated into a first material surface of a garment material and is positioned such that the first axis 311 is approximately parallel to a sagittal plane 110 of a user, when the garment is worn, along a first lateral aspect of the aquatic sport performance garment from approximately and first armpit region 111 or a ribcage region immediately below the armpit region, to a first hip region 113; and a second longitudinal restraint strip 104 having a third end 303 and a fourth 304 end and a second axis 312 extending from the third end 303 to the fourth end 304, affixed to or integrated into a second material surface of the wetsuit material and is positioned such that the second axis 312 is approximately parallel to the sagittal plane 110 along a second lateral aspect of the garment 201, opposite the first lateral aspect of the garment, approximately from a second armpit region 112, 203, or a ribcage region immediately below the armpit region, to a second hip region 114, 204. When assembled in the aquatic sport performance garment, the first longitudinal restraint strip 103 and the second longitudinal restraint strip 104 form a parallel "| |" pattern that in and of itself provides lateral stability for the user by making the lateral portions of the wetsuit stiffer to reduce or minimize side-side bending about the user's waist, thus minimizing "wiggle" or "hip yaw" and improving overall "torso and body yaw" along the longitudinal axis, as well as generally improving body position along the longitudinal axis (pitch) of the swimmer.

In some embodiments, the aquatic sport performance garment is further configured to encourage a rolling rotation of the torso of a user when the garment is worn and thus further comprises: a first diagonal restraint strip comprising, a fifth end, a sixth end, and a third axis extending from the fifth end to the sixth end, wherein the first diagonal restraint strip is affixed to a third material surface across a back region of the aquatic performance garment material or is integrated into the aquatic sport performance garment material, and is positioned diagonally such that the third axis is posteriorly offset from a coronal plane of the user when the garment is worn, wherein the fifth end is positioned in contact with or in proximity to the first end of the first longitudinal restraint strip, and the sixth end is positioned in contact with or in proximity to the fourth end of the second longitudinal restraint strip. A second diagonal restraint strip comprising a seventh end, an eighth end, and a fourth axis extending from the seventh end to the eighth end is affixed to the third material surface across the back region of the aquatic performance garment material or is integrated into the aquatic sport performance garment material, and is positioned diagonally such that the fourth axis is posteriorly offset from the coronal plane, wherein the seventh end is positioned in contact with or in proximity to the third end of the second longitudinal restraint strip, and the eighth end of the second diagonal restraint strip is positioned in contact with or in proximity to the second end of the first longitudinal restraint strip. The first diagonal restraint strip and the second diagonal restraint strip form an intersecting "X" pattern, wherein the first diagonal restraint strip and the second diagonal restraint strip are configured to encourage a rolling rotation of the torso of the user when the garment is worn.

In some embodiments of the aquatic sport performance garment, the first longitudinal restraint strip and the second longitudinal restraint strip further comprise a first modulus of elasticity that is approximately two or more times greater than a second modulus of elasticity of the aquatic sport performance garment material to which it is affixed or into which it is integrated.

As further illustrated in FIGS. 1, 2 and 3A, the aquatic sport performance garment comprises, a first crossing restraint strip 105 having a fifth end 305 and a sixth end 306, and a third axis 313 extending from the fifth end 305 to the sixth end 306 affixed to a third material surface across a back (posterior) region of the aquatic performance garment material or is integrated into the aquatic sport performance garment material, wherein the fifth end 305 of the first crossing restraint strip 105 is positioned in contact with or in proximity to the first end 301 of the first longitudinal restraint strip 103, and the sixth end 306 of the first crossing restraint strip is positioned in contact with or in proximity to the fourth end 304 of the second longitudinal restraint strip 104, and a second crossing restraint strip 106 having a seventh end 307 and a eighth end 308, and a fourth axis 314 extending from the seventh end 307 to the eighth end 308 wherein the second diagonal restraint strip 106 is affixed to the third material surface across the back region of the aquatic performance garment material or is integrated into the aquatic sport performance garment material, and is positioned diagonally such that the fourth axis 314 is posteriorly offset from the coronal plane 210, wherein the seventh end 307 of the second crossing restraint strip 106 is positioned in contact with or in proximity to the third end 303 of the second longitudinal restraint strip 104, and the eighth end 308 of the second crossing restraint strip is positioned in contact with or in proximity to the second end 302 of the first longitudinal restraint strip 103. When assembled, the first crossing restraint strip 105 and the second crossing restraint strip 106 form an intersecting "X" pattern, which by itself has the effect of activating extra skeletal and core muscle structures of a user, generally located within a midsection region 107 of the aquatic sport performance garment and further serves to tie the hip complex on one side of a swimmer with the opposing shoulder complex on the opposite side of the swimmer, which in turn improves "roll" mechanics.

In some embodiments of the aquatic sport performance garment, the first diagonal restraint strip and the second diagonal restraint strip further comprise a third modulus of elasticity that when stretched 10%, is approximately two or more times greater than the second modulus of elasticity of the aquatic sport performance garment material to which it is affixed or integrated.

In total, the entire pattern of this restraint system with both longitudinal restraints and both crossing restraints forms a "|X|" pattern. The combined pattern has the combined effect of inhibiting side-to-side bending of a torso and encouraging a rolling rotation of the torso of the user, while also improving the swimmer's "pitch", helping to generate a more streamlined, longitudinal profile (less "yaw") in the water when the garment is worn.

Provided herein is an aquatic sport performance garment configured to encourage a rolling rotation of the torso of a user when the garment is worn, the garment having a first armpit region, a second armpit region, a first hip region, and a second hip region, the garment comprising: a first diagonal restraint strip comprising, a fifth end, a sixth end, and a third axis extending from the fifth end to the sixth end, wherein the first diagonal restraint strip is affixed to a third material surface across a back region of the aquatic performance garment material or is integrated into the aquatic sport performance garment material, and is positioned diagonally such that the third axis is posteriorly offset from a coronal plane of the user when the garment is worn, wherein the fifth end is positioned and affixed along a first lateral aspect of the performance garment at or about the first armpit region approximately parallel to a sagittal plane of the user when the garment is worn, and the sixth end is positioned and affixed along a second lateral aspect of the performance garment at or about the second hip region approximately parallel to the sagittal plane. A second diagonal restraint strip comprising, a seventh end, an eighth end, and a fourth axis extending from the seventh end to the eighth end, is affixed to the third material surface across the back region of the aquatic performance garment material or is integrated into the aquatic sport performance garment material, and is positioned diagonally such that the fourth axis is posteriorly offset from the coronal plane, wherein the seventh end is positioned and affixed along the second lateral aspect of the performance garment at or about the second armpit region approximately parallel to the sagittal plane, and the eighth end is positioned and affixed along the first lateral aspect of the performance garment at or about the first hip region approximately parallel to the sagittal plane; wherein the first diagonal restraint strip and the second diagonal restraint strip form an intersecting "X" pattern.

The first diagonal restraint strip and the second diagonal restraint strip further comprise a third modulus of elasticity that when stretched 10%, is approximately two or more times greater than a second modulus of elasticity of the aquatic sport performance garment material to which they are affixed or into which they are integrated.

As previously described and illustrated in FIGS. 1, 2 and 3A, the aquatic sport performance garment comprises, a first crossing restraint strip 105 having a fifth end 305 and a sixth end 306, and a third axis 313 extending from the fifth end 305 to the sixth end 306 affixed to a third material surface across a back (posterior) region of the aquatic performance garment material or is integrated into the aquatic sport performance garment material, wherein the fifth end 305 of the first crossing restraint strip 105 is positioned in contact with or in proximity to the first end 301 of the first longitudinal restraint strip 103, and the sixth end 306 of the first crossing restraint strip is positioned in contact with or in proximity to the fourth end 304 of the second longitudinal restraint strip 104, and a second crossing restraint strip 106 having a seventh end 307 and a eighth end 308, and a fourth axis 314 extending from the seventh end 307 to the eighth end 308 wherein the second diagonal restraint strip 106 is affixed to the third material surface across the back region of the aquatic performance garment material or is integrated into the aquatic sport performance garment material, and is positioned diagonally such that the fourth axis 314 is posteriorly offset from the coronal plane 210, wherein the seventh end 307 of the second crossing restraint strip 106 is positioned in contact with or in proximity to the third end 303 of the second longitudinal restraint strip 104, and the eighth end 308 of the second crossing restraint strip is positioned in contact with or in proximity to the second end 302 of the first longitudinal restraint strip 103.

In some embodiments, the aquatic sport performance garment is configured to inhibit side-to-side bending of a torso of a user when the garment is worn, and thus further comprises: a first longitudinal restraint strip comprising; a first end, a second end, and a first axis extending from the first end to the second end, wherein the first longitudinal restraint strip is affixed to a first material surface of an aquatic performance garment material or is integrated into the first material surface of the aquatic sports performance garment material, and is positioned such that the first axis is approximately parallel to the sagittal plane along the first lateral aspect of the performance garment approximately from the first armpit region to the first hip region; and a second longitudinal restraint strip comprising; a third end, a fourth end, and a second axis extending from the third end to the fourth end, wherein the second longitudinal restraint strip is affixed to a second material surface of the aquatic performance garment material or is integrated into the second material surface of the aquatic sport performance garment material, and is positioned such that the second axis is approximately parallel to the sagittal plane along the second lateral aspect of the performance garment approximately from the second armpit region to the second hip region, wherein the first longitudinal restraint strip and second longitudinal restraint strip are configured to inhibit side-to-side bending of a torso of a user when the garment is worn.

As previously described and illustrated in FIGS. 1, 2 and 3A, the aquatic sport performance garment is configured to inhibit side-to-side bending of the torso of a user's body when the wetsuit is worn by the user while swimming, the garment comprising: a first longitudinal restraint strip 103 having a first end 301 and a second end 302 and a first axis 311 extending from the first end 301 to the second end 302, affixed to or integrated into a first material surface of a garment material and is positioned such that the first axis 311 is approximately parallel to a sagittal plane 110 of a user, when the garment is worn, along a first lateral aspect of the aquatic sport performance garment from approximately and first armpit region 111 or a ribcage region immediately below the armpit region, to a first hip region 113; and a second longitudinal restraint strip 104 having a third end 303 and a fourth 304 end and a second axis 312 extending from the third end 303 to the fourth end 304, affixed to or integrated into a second material surface of the wetsuit material and is positioned such that the second axis 312 is approximately parallel to the sagittal plane 110 along a second lateral aspect of the garment 201, opposite the first lateral aspect of the garment, approximately from a second armpit region 112, 203, or a ribcage region immediately below the armpit region, to a second hip region 114, 204.

Figure 4:
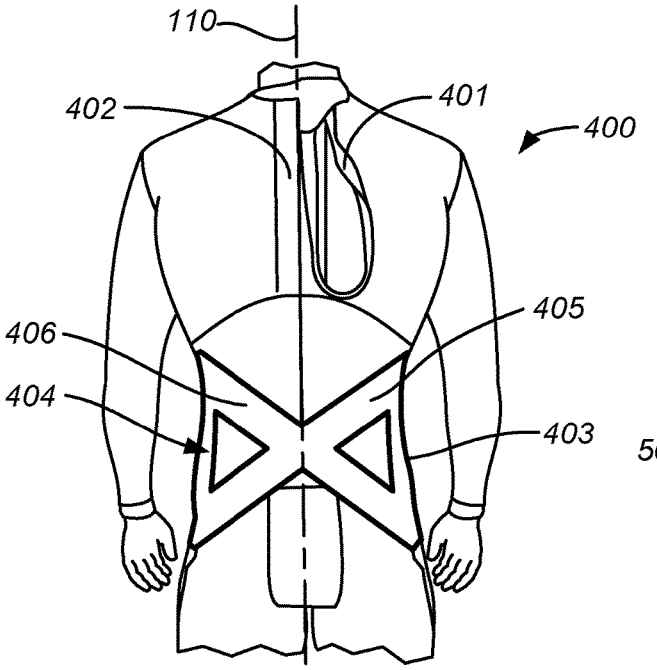
FIG. 4 is a back view of another illustrative example of a sports performance garment or wetsuit illustrating representative positioning of a restraint pattern in relation to other features of the wetsuit in accordance with the teachings herein.

In still other alternate embodiments of the wetsuit 400, as illustrated in FIG. 4, the restraints may be fabricated with alternate materials and/or alternate material properties in order to obtain different results from each restraint strip pair. For example, the longitudinal lateral restraint strip pair (403, 404) may require greater or lesser stiffness, or be wider or narrower than the diagonal or criss-cross restraint strip pair (405, 406). Alternatively the diagonal or criss-cross restraint strip pair (405, 406) may require more or less elasticity or a different direction of stretch than the longitudinal lateral restraint pair (403, 404). Further still, the diagonal or criss-cross constraint pair (405, 406) may be alternately positioned in a higher (more superior, closer to the head) or lower (more inferior, closer to the feet) location along the longitudinal axis 110 to accommodate specific equipment requirements such as the location of a zipper 402, and pull cord 401, or due to a swimmer's specific needs, such as a physical handicapped or for example, a paraplegic swimmer with limited or no use of their legs.

Figure 5:
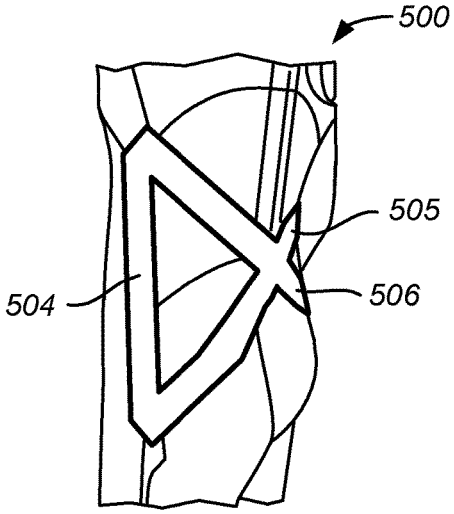
FIG. 5 is an oblique left side view of another illustrative example of a sports performance garment or wetsuit illustrating representative positioning of a modified restraint pattern, such as FIG. 3B or 3C, in relation to other features of the wetsuit in accordance with the teachings herein.

In still other alternate embodiments of the wetsuit 500, as illustrated in FIG. 5, the restraints may be fabricated with alternate shapes to account for anatomic features of a swimmers body or to accommodate physiologic anatomic differences between men and women. For example the criss-cross restraints (505, 506) are configurable such that they are not be "straight" per se, or even the same width over their length, but rather, are be fabricated with bends to accommodate the variable hip anatomy between men and women, and potentially will not intersect or approach the lateral restraints 504 in the same area. Additionally, in some embodiments, the width of the restraints will vary along their lengths in order to provide variable degrees of tension or compression to the core muscle groups. Further still, it has been found that different tensions applied to the diagonal or criss-cross strap can help control or reduce the formation of air pockets that sometime form inside the wetsuit. In a similar fashion, in some embodiments, the width and thickness of the longitudinal lateral restraints (i.e. 503) will also vary to accommodate the variable hip and lateral anatomy between men and women, as well as to provide variable degrees of desired stiffness, tension or compression within or about the lateral core muscle groups.

As noted previously, it is anticipated that the wetsuit's restraint strips are variable in almost every aspect, including lengths, widths, thicknesses, stiffnesses, percentage of elongation and modulus of elasticity, as needed to accommodate specific user needs or a user group's needs.

Figure 6:
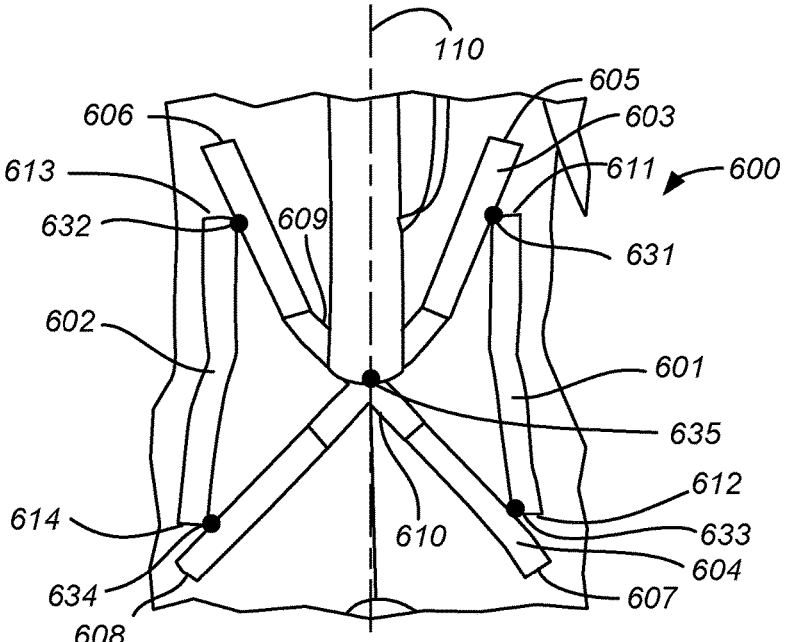
FIG. 6 is a back view of another illustrative example of a sports performance garment or wetsuit illustrating representative positioning of a modified restraint pattern, such as FIG. 3C, illustrating relative positions of fixation points at or about the locations of restraint strip endpoint intersections or contact proximities for the restraint endpoints.

Further still, as illustrated in FIG. 6, the wetsuit 600 and constraint system comprising variations of the individual restraint strip pairs (601/602 and 603/604) can be configured wherein the restraint strips are fabricated from multiple materials having multiple characteristics and mechanical properties in order to achieve locally specific effects on the core muscle groups and/or musculoskeletal complexes.

Finally, as will become apparent in subsequent discussion, the restraint strips are configurable with multiple modulus "zones" that would allow the restraints and the underlying aquatic sport performance garment material to which they are attached, to perform differently or exhibit different reactions to different movements or loads applied to the garment by a user.

As will now be obvious to one skilled in the art upon reading this disclosure, either of the "sub-patterns"; the intersecting "X" pattern, or the parallel "| |" pattern can also be applied individually to an aquatic sports performance garment or wetsuit.

Further, as will now be obvious to one skilled in the art upon reading this disclosure, either of the "sub-patterns"; the intersecting "X" pattern, or the parallel "| |" pattern; and/or the combined "|X|" pattern can also be individually or jointly applied to a swimming suit.

Alternatively, as will now be obvious to one skilled in the art upon reading this disclosure, either of the "sub-patterns"; the intersecting "X" pattern, or the parallel "| |" pattern; and/or the combined "|X|" pattern can also be individually or jointly applied to a compression garment.

Further still, as will now be obvious to one skilled in the art upon reading this disclosure, either of the "sub-patterns"; the intersecting "X" pattern, or the parallel "| |" pattern; and/or the combined "|X|" pattern can also be individually or jointly supplied in pre-made patterns or with directions and templates and applied directly to the body (i.e. skin) of an individual for the same effect. For example, the inventors have envisioned utilizing sports compression tape (AKA: kinesiology tape), marketed under a plethora of trade names, and providing instructions along with pattern diagrams (templates) to instruct user's in the application of these and other patterns to treat and correct for a host of inefficient movements for both swimmers and triathletes.

As can be seen in FIG. 3A, some embodiments of the aquatic sport performance garment further comprises fixation points at or about the intersections of the restraining strips. For example, a first fixation point 11 in contact with or in proximity to the first end 301 of the first longitudinal restraint strip 103 and the fifth end 305 of the first crossing restraint strip 105; a second fixation point 12 in contact with or in proximity to the seventh end 307 of the second crossing restraint strip 106 and the third end 303 of the second longitudinal restraint strip 104; a third fixation point 13 in contact with or in proximity to the second end 302 of the first longitudinal restraint strip 103 and the eighth end 308 of the second crossing restraint strip 106; a fourth fixation point 14 in contact with or in proximity to the sixth end 306 of the first crossing restraint strip 105 and the fourth end 304 of the second longitudinal restraint strip 104; and a fifth fixation point 15 at the intersection 309 of the third and fourth axes 313, 314, of the first crossing restraint strip 105 and the second crossing restraint strip 106. The first and second longitudinal restraint strips are essentially coupled to the first and second crossing restraint strips; the first and second crossing restraint strips are essentially coupled to each other, and the first fixation point, second fixation point, third fixation point, fourth fixation point and fifth fixation point are also affixed to a surface, or integrated into, the material of the aquatic sport performance garment, as illustrated in garments 100, 200, 400, 500 and 600.

In some embodiments, the first, second, third, fourth and fifth fixation points 11, 12, 13, 14 and 15, comprise: a glue; an epoxy; a rivet; an ultrasonic weld; and a thread comprising; a polyester, a nylon, a cotton, a silk, a wool, a rayon, or any combination thereof.

In some embodiments, the aquatic sport performance garment has a fixation medium between a surface of each restraint strip and the adjoining material surface of the garment comprising: a glue comprising; a polyvinyl acetate (PVA), a polyurethane, a cyanoacrylates (super glues), or a craft glue; an epoxy; a spray adhesive; an ultrasonic weld; or any combination thereof.

Figure 3B:
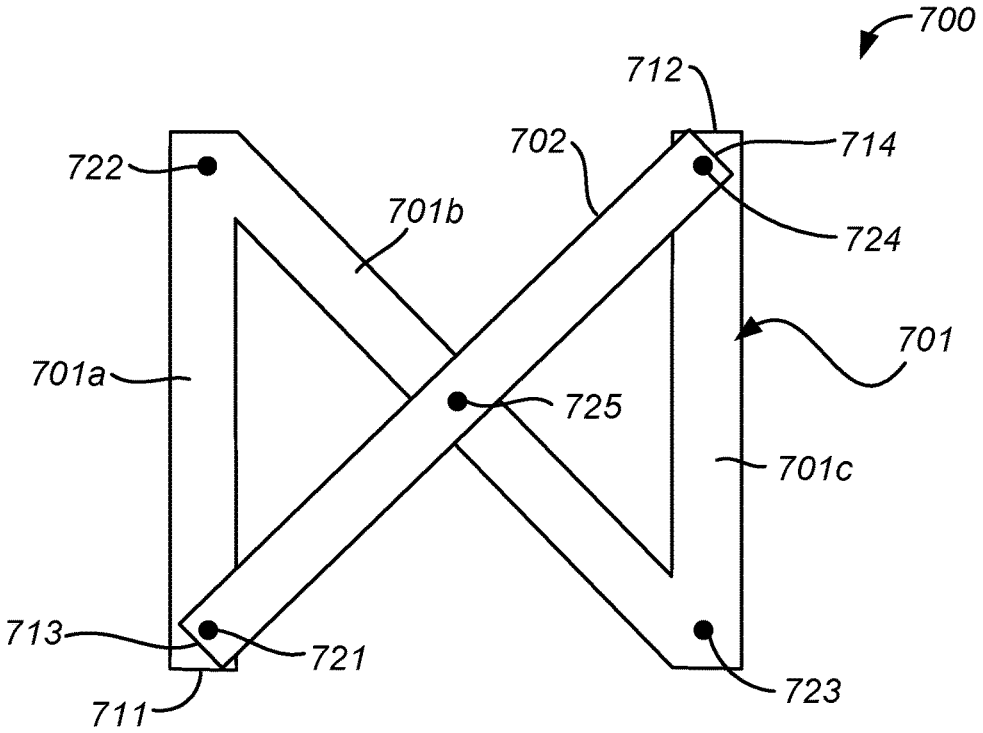
FIG. 3B is another simplified representative illustration of a restraint system showing the potential interaction between the longitudinal restraints of an "N" pattern restraint and a second crossing restraint "／" forming a "⋈" pattern.

Provided herein is an alternative aquatic sports performance garment or wetsuit garment with a unique restraint system 700 configured to inhibit side-to-side bending of a torso and encourage a rolling rotation of the torso of the user when the garment is worn, the garment having a first armpit region, a second armpit region, a first hip region, and a second hip region, the garment comprising: a continuous "N" shaped, inverted (upside-down) "N" shaped or stylized "N" shaped first restraint strip 701 such as that illustrated in FIG. 3B comprising: a first unattached end 711 on a first leg 701*a*, a second unattached end 712 on a third leg 701*c*, and a second leg 701*b* positioned diagonally and connecting the attached end of the first leg 701*a* and attached end of the third leg 701*c* in a continuous "N" pattern, wherein the first leg wherein the first leg 701*a* of the continuous "N" shaped, inverted "N" shaped or stylized "N" shaped restraint strip is affixed to a first material surface of a wetsuit material or is integrated into the wetsuit material, and is positioned such that the first leg 701*a* is approximately parallel to a sagittal plane 110 of a user when the wetsuit is worn, along a first lateral aspect of the wetsuit, from the first armpit region 111 to the first hip region 113, wherein the third leg 701*c* of the continuous "N" shaped, inverted "N" shaped or stylized "N" shaped restraint strip 701 is affixed to a second material surface of the wetsuit material opposite the first material surface or is integrated into the wetsuit material, and is positioned such that the third leg 701*c* is approximately parallel to the sagittal plane 110 along a second lateral aspect 201 of the aquatic sport performance garment from the second armpit region 112 to the second hip region 114, and wherein the second diagonally positioned leg 701*b* of the continuous "N" shaped, inverted "N" shaped or stylized "N" shaped restraint strip is affixed to a third material surface across a back region of the wetsuit material or is integrated into the wetsuit material, and is positioned such that the second leg 701*b* is posteriorly offset from a coronal plane 210 of the user when the garment is worn; a second restraint strip 702 comprising: a third end 713, a fourth end 714, wherein the second restraint strip 702 is affixed to the third material surface across a back region of the aquatic performance garment material or is integrated into the aquatic sport performance garment material, and is positioned diagonally such that the second restraint strip is posteriorly offset from the coronal plane 210 of the user when the garment is worn, wherein the third end 713 is positioned in contact with or in proximity to the first end 711 of the first leg 701*a* of the continuous "N" shaped, inverted "N" shaped or stylized "N" shaped restraint strip, and the fourth end 714 is positioned in contact with or in proximity to the second end 712 of the third leg 701*c* of the continuous "N" shaped, inverted "N" shaped or stylized "N" shaped restraint strip, wherein the "N" shaped, inverted "N" shaped or stylized "N" shaped restraint strip and the second restraint strip form an "⋈" pattern 700.

Similar to the Restraint system of FIG. 3A, some embodiments of the continuous "N" shaped, inverted "N" shaped or stylized "N" shaped restraint strip with a diagonally crossing restraint 700 also comprise fixation points, such as 721, 722, 723, 724 and 725 which function in the same manner and are similarly attached as the fixation points 14, 12, 13, 11 and 15 illustrated in FIG. 3A.

Provided herein is another alternative aquatic sports performance garment or wetsuit garment with a unique restraint system 600 configured to inhibit side-to-side bending of a torso and/or to encourage a rolling rotation of the torso of the user when the garment is worn, such as that illustrated in FIG. 6; the garment having a first armpit region, a second armpit region, a first hip region, and a second hip region, the wetsuit comprising: a first longitudinal restraint strip 601 comprising; a first end 611, a second end 612, wherein the first longitudinal restraint strip 601 is affixed to a first material surface of a wetsuit material or is integrated into the wetsuit material, and is positioned such that the first longitudinal restraint strip is approximately parallel to a sagittal plane 110 of a user when the wetsuit is worn, along a first lateral aspect of the wetsuit from the first armpit region to the first hip region; a second longitudinal restraint strip 602 comprising; a third end 613, a fourth end 614, wherein the second longitudinal restraint strip 602 is affixed to a second material surface of the wetsuit material or is integrated into the wetsuit material, and is positioned such that the second longitudinal restraint strip is approximately parallel to the sagittal plane 110 along a second lateral aspect of the wetsuit from the second armpit region to the second hip region; a first "U"-shaped, "V"-shaped or stylized "U"-shaped restraint strip 603 comprising: a fifth end 6055; and a sixth end 606 wherein the first "U"-shaped, "V"-shaped or stylized "U"-shaped restraint strip is positioned across a third posterior material surface such that the fifth end 605 of the first "U"-shaped, "V"-shaped or stylized "U"-shaped restraint strip is in proximity to or connected to the first end 611 of the first longitudinal restraint strip 601 and the sixth end 606 of the first "U"-shaped, "V"-shaped or stylized "U"-shaped restraint strip is in proximity to or connected to the third end 613 of the second longitudinal restraint strip 602. A second "U"-shaped, "V"-shaped or stylized "U"-shaped restraint strip 604 comprising: a seventh end 607; and an eighth end 608; wherein the second "U"-shaped, "V"-shaped or stylized "U"-shaped restraint strip 604 is positioned across the third posterior material surface such that the seventh end 607 of the second "U"-shaped, "V"-shaped or stylized "U"-shaped restraint strip is in proximity to or connected to the second end 612 of the first longitudinal restraint strip 601 and the eighth end 608 of the second "U"-shaped, "V"-shaped or stylized "U"-shaped restraint strip 604 is in proximity to or connected to the fourth end 614 of the second longitudinal restraint strip 602. The first "U"-shaped, "V"-shaped or stylized "U"-shaped restraint strip 603 and the second "U"-shaped, "V"-shaped or stylized "U"-shaped restraint strip 604 are positioned in contact with or in proximity to each other at or about a first apex region 609 of the first "U"-shaped, "V"-shaped or stylized "U"-shaped restraint strip and a second apex region 610 of the second "U"-shaped, "V"-shaped or stylized "U"-shaped restraint strip, and wherein the first apex region and the second apex region intersect the sagittal plane 110 of the third posterior material surface of the wetsuit forming a modified criss-cross pattern.

Similar to the restraint systems illustrated in FIGS. 1, 3A, 3B and 3C, some embodiments of the "U"-shaped, "V"-shaped or stylized "U"-shaped restraint strip 600 also comprise fixation points, such as 631, 632, 633, 634 and a fixation point 635 about the first apex 609 of the first "U"-shaped, "V"-shaped or stylized "U"-shaped restraint strip and the second apex 610 of the second "U"-shaped, "V"-shaped or stylized "U"-shaped restraint strip; wherein the first and second apex are essentially coupled to each other and to the wetsuit, wherein, all of which function in the same manner and are similarly attached as the fixation points 14, 12, 13, 11 and 15 illustrated in FIG. 3A.

In any one of the embodiments of the aquatic sport performance garment, the first longitudinal restraint strip 103 and the second longitudinal restraint strip 104 comprise a first modulus of elasticity that when stretched 10% is approximately two or more times greater than the second modulus of elasticity of the aquatic performance garment material 100, 200, 400, 500 or 600 to which it is affixed or into which it is integrated.

In any one of the embodiments of the aquatic sport performance garment, the first crossing restraint strip 105 and the second crossing restraint strip 106 further comprise a third modulus of elasticity that when stretched 10% is approximately two or more times greater than the second modulus of elasticity of the aquatic performance garment material as shown in garments 100, 200, 400, 500 or 600 to which it is affixed, and wherein the first crossing restraint strip 105 and the second crossing restraint strip 106 further encourage rotation of the torso of the user's body by, pulling the first hip region of the user's body upward and toward the second armpit region while causing second hip region to roll downward when a second arm is raised above and in front of the swimmer's head, and pulling the second hip region of the user's upward and toward the first armpit region while causing the first hip region to roll downward when a first arm is raised above and in front of the swimmer's head.

In one embodiment of the aquatic sport performance garment the restraints comprise one or more nylon-type hot-melt adhesive tapes having a 10% modulus of elasticity/20 mm ranging between 0.6 kgf and 1.1 kgf. Whereas, the material for the aquatic sport performance garment, which in one embodiment is nylon and/or polyester blended neoprene, has a 50% modulus of elasticity ranging between 0.31 and 0.43 kgf, depending on the thickness.

In any one of the embodiments of the aquatic sport performance garment, the first longitudinal restraint strip and the second longitudinal restraint strip comprise a first material stiffness greater than a second material stiffness of the aquatic sports performance garment material to which it is affixed, wherein the first or second material stiffness comprises an axial stiffness or a rotational stiffness.

In some embodiments of the aquatic sport performance garment, the first diagonal restraint strip and the second diagonal restraint strip further comprise a third modulus of elasticity that is approximately two or more times greater than the second modulus of elasticity of the aquatic sport performance garment material to which it is affixed or integrated, when stretched 10%.

As noted previously, when again referring to an embodiment of the aquatic sport performance garment having restraints comprising one or more nylon-type hot-melt adhesive tapes having a 10% modulus of elasticity/20 mm ranging between 0.6 kgf and 1.1 kgf, and the material for the aquatic sport performance garment, which has nylon and/or polyester blended neoprene, with a 50% modulus of elasticity ranging between 0.31 and 0.43 kgf, depending on the thickness, we refer to young's modulus to determine stiffness. Since Young's modulus measures the resistance of a material to elastic (recoverable) deformation under load, we know that the stiff material (the nylon-type hot-melt adhesive tape) has a high Young's modulus and changes its shape only slightly under elastic loads. Whereas the aquatic sports performance garment material is a highly flexible material with a low Young's modulus and changes its shape considerably (e.g. rubbers). Hence the first and second longitudinal restraint strips comprising nylon-type hot-melt adhesive tapes comprise a stiffness greater than the aquatic sport performance garment.

In any one of the embodiments of the aquatic sport performance garment, the material of the aquatic sports performance garment comprises: a rubber material; a nylon material; a rayon material; a polyurethane material; an elastic polyurethane material; a polyester material; or any combination thereof.

Many sports/aquatic garments or other swimwear commonly comprise a nylon; a polypropylene; a rayon material; an elastic polyurethane material, [e.g. Lycra®, Spandex® or Elastane®]; a polyester material; a Poly PBT material, [polyester-PBT, or polybutylene terephthalate]; a XLA material, [a polyolefin elastic fiber]; or a combination thereof).

In any one of the embodiments of the aquatic sport performance garment, the first longitudinal restraint strip, second longitudinal restraint strip, first diagonal restraint strip and second diagonal restraint strips comprise: a rubber material; a textile material; a commercially pure titanium or titanium alloy; a commercially pure tantalum or tantalum alloy; a commercially pure copper or copper alloy; a silicone material; a neoprene material; a nylon material; a polypropylene material; a rayon material; a polyurethane material; an elastic polyurethane material; a polyester material; a Poly PBT material; a XLA material; or a combination thereof. Other possible restraint materials include a grouping of synthetic materials comprising acrylic, acetate, silk, latex, and/or latex, to name but a few.

In any one of the embodiments of the aquatic sport performance garment, any one of the first longitudinal restraint strip, second longitudinal restraint strip, first diagonal restraint strip and second diagonal restraint strips and the aquatic sport performance garment material comprise the same materials.

In any one of the embodiments of the aquatic sport performance garment, any one of the first longitudinal restraint strip, second longitudinal restraint strip, first diagonal restraint strip and second diagonal restraint strips and the aquatic sport performance garment material comprise different materials.

Figure 7A:
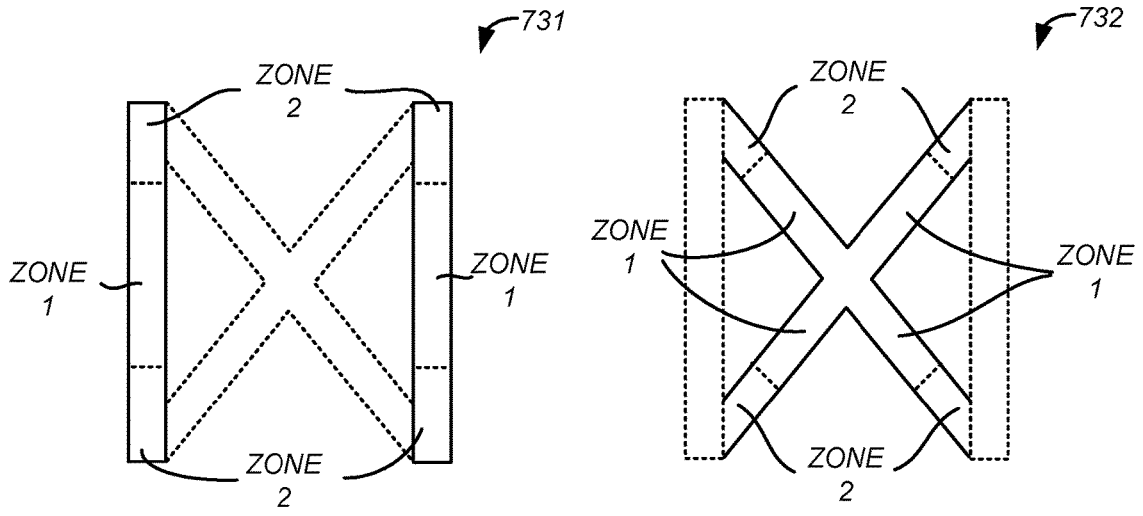
FIG. 7A illustrates multiple representative views of a restraint pattern, such as FIG. 3A, illustrating how the individual longitudinal restraint strips "|" or the individual diagonal "/", "\" crossing restraint strips can have multiple zones comprising different moduli of elasticity. These restraint patterns also illustrate that the restraints can be applied separately or together, or as an additional accessory of a manufactured garment, or supplied separately as an "add-on" accessory, to be applied directly to skin.
Figure 7B:
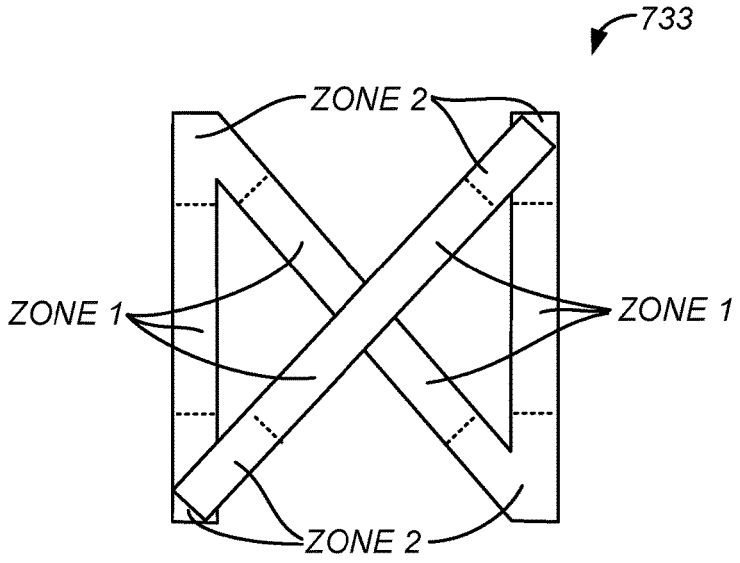
FIG. 7B illustrates a representative view of an alternatively configured restraint pattern, such as FIG. 3B, illustrating how the individual legs of the "N" restraint strip or the diagonal "/" crossing restraint strip can have multiple zones comprising different moduli of elasticity. These restraint patterns also illustrate that the restraints can be applied separately or together, or as an additional accessory of a manufactured garment, or supplied separately as an "add-on" accessory, to be applied directly to skin.
Figure 7C:
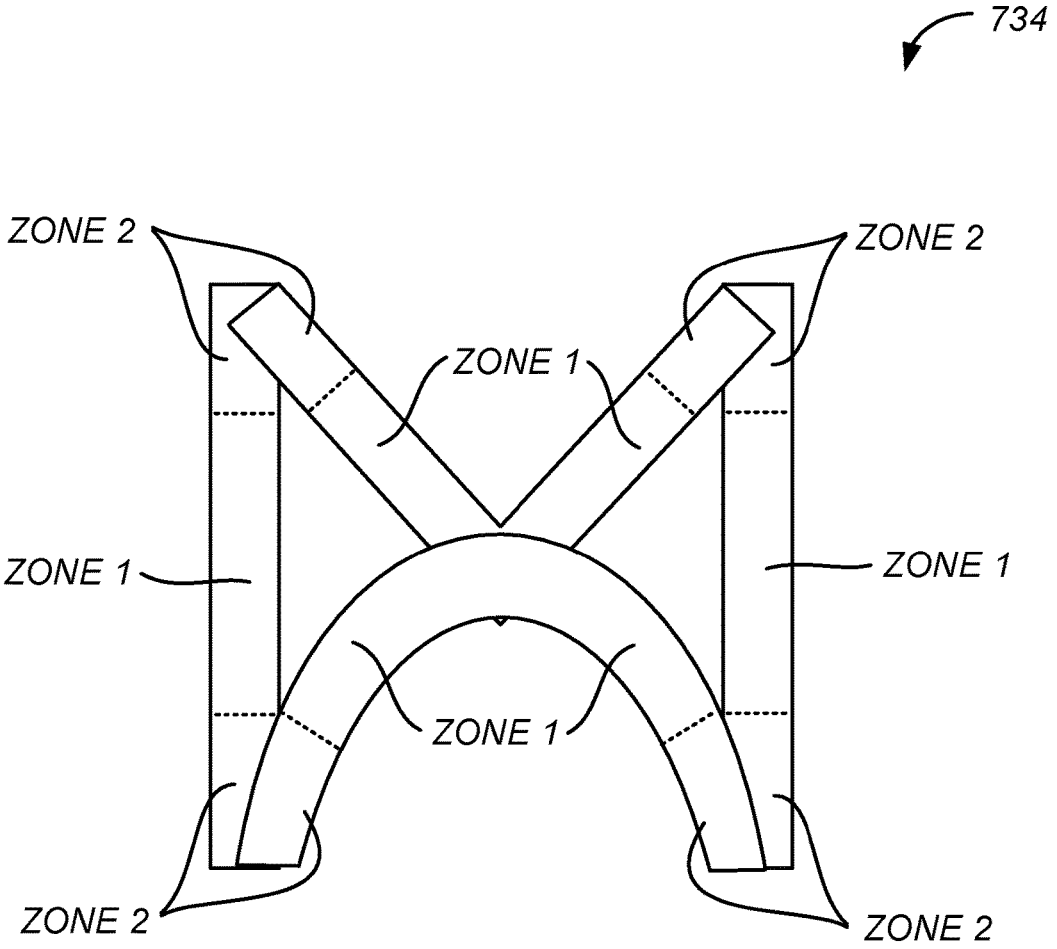
FIG. 7C is illustrates yet another alternative representation of a restraint pattern, such as FIG. 3C, illustrating how the individual longitudinal restraint strips "|" or the stylized "U" and/or "V" criss-cross "ϒ", "ϒ" "ϒ" or "X" crossing restraint strips can have multiple zones comprising different moduli of elasticity. These restraint patterns also illustrate that the restraints can be applied separately or together, or as an additional accessory of a manufactured garment, or supplied separately as an "add-on" accessory, to be applied directly to skin.

As noted in FIGS. 7A-7C, any one of the restraint strips or pairs of restraint strips 731, 732, 733 or 734 are configurable with two or more materials, including two or more of the same material, each material comprising different performance properties. The materials are configurable in "zones" such as zone 1 and zone 2 that would allow the restraints and the underlying connected aquatic sport performance garment material to perform differently or exhibit different reactions to different movements or loads applied to the garment by a user.

Correspondingly, in any one of the embodiments of the aquatic sport performance garment, the first diagonal restraint strip and the second diagonal restraint strip 105, 106 701*b*, 702, 803 or 804 each comprise two or more materials, wherein each material comprises a different modulus of elasticity.

In any one of the embodiments of the aquatic sport performance garment, the first longitudinal restraint strip and the second longitudinal restraint strip 103, 104, 701*a*, 701*c*, 801 or 802 each comprise two or more materials, wherein each material comprises a different modulus of elasticity.

In any one of the embodiments of the aquatic sport performance garment, the garment is configurable in one, two or more layers of material to provide different compression and or heat retention properties for the user. In some of these embodiments, any one or more of the first longitudinal restraint strip, second longitudinal restraint strip, first diagonal restraint strip and second diagonal restraint strips are affixed to or incorporated into an internal material surface of the aquatic sport performance garment; any one or more of the first longitudinal restraint strip, second longitudinal restraint strip, first diagonal restraint strip and second diagonal restraint strips are affixed to or incorporated into an external material surface of the aquatic sport performance garment; any one or more of the first longitudinal restraint strip, second longitudinal restraint strip, first diagonal restraint strip and second diagonal restraint strips are affixed to or incorporated into a material surface between layers of the aquatic sport performance garment; any one or more of the first longitudinal restraint strip, second longitudinal restraint strip, first diagonal restraint strip and second diagonal restraint strips are affixed to or incorporated into a material surface between internal panels of the aquatic sport performance garment; or any combination thereof.

In any one of the embodiments of the aquatic sport performance garment described thus far, the garment comprises; a wetsuit; a swimsuit; a body suit; a compression garment; or a combination thereof.

Provided herein is a wetsuit garment 100, 200, 400, 500, as illustrated in FIGS. 1, 2, 4 and 5, configured to inhibit side-to-side bending of a torso and encourage a rolling rotation of the torso of the user when the garment is worn, the garment having a first armpit region 111, a second armpit region 112, 203, a first hip region 113, and a second hip region 114, 204, the wetsuit comprising: a first longitudinal restraint strip 103 comprising; a first end, a second end, and a first axis extending from the first end to the second end, wherein the first longitudinal restraint strip is affixed to a first material surface of a wetsuit material or is integrated into the wetsuit material, and is positioned such that the first axis is approximately parallel to a sagittal plane 110 of a user when the wetsuit is worn, along a first lateral aspect of the wetsuit from the first armpit region 111 to the first hip region 113; a second longitudinal restraint strip 104 comprising; a third end, a fourth end, and a second axis extending from the third end to the fourth end, wherein the second longitudinal restraint strip 104 is affixed to a second material surface of the wetsuit material or is integrated into the wetsuit material, and is positioned such that the second axis is approximately parallel to the sagittal plane 110 along a second lateral aspect of the wetsuit 201 from the second armpit region 112, 203 to the second hip region 114, 204; a first crossing restraint strip 105 comprising, a fifth end, a sixth end, and a third axis extending from the fifth end to the sixth end, wherein the first crossing restraint strip 105 is affixed to a third material surface across a back region, crossing a midsection of the torso 107 of the wetsuit material, or is integrated into the wetsuit material, and is positioned diagonally such that the third axis is posteriorly offset from a coronal plane 210 of the user when the wetsuit is worn, wherein the fifth end is positioned in contact with or in proximity to the first end of the first longitudinal restraint strip 103, and the sixth end is positioned in contact with or in proximity to the fourth end of the second longitudinal restraint strip 104; and a second crossing restraint strip 106 comprising a seventh end, an eighth end, and a fourth axis extending from the seventh end to the eighth end wherein the second crossing restraint strip 106 is affixed to the third material surface across the back region, crossing a midsection of the torso 107 of the wetsuit material, or is integrated into the wetsuit material, and is positioned diagonally such that the fourth axis is posteriorly offset from the coronal plane 210, wherein the seventh end is positioned in contact with or in proximity to the third end of the second longitudinal restraint strip 104, and the eighth end of the second diagonal restraint strip is positioned in contact with or in proximity to the second end of the first longitudinal restraint strip 103. The first crossing restraint strip 105 and the second crossing restraint strip 106 generate an intersecting "X" pattern.

In some embodiments, the first longitudinal restraint strip and the second longitudinal restraint strip have a first stiffness greater than a second stiffness of the wetsuit material to which it is affixed, and wherein the first or second material stiffness comprises an axial stiffness and/or a rotational stiffness.

As illustrated in FIG. 3, in some embodiments, the wetsuit further comprises: a first fixation point 11 in contact with or in proximity to the first end of the first longitudinal restraint strip 103 and the fifth end of the first crossing restraint strip 105; a second fixation point 12 in contact with or in proximity to the seventh end of the second crossing restraint strip 106 and the third end of the second longitudinal restraint strip 104; a third fixation point 13 in contact with or in proximity to the second end of the first longitudinal restraint strip 103 and the eighth end of the second crossing restraint strip 106; a fourth fixation point 14 in contact with or in proximity to the sixth end of the first crossing restraint strip 105 and the fourth end of the second longitudinal restraint strip 104; and a fifth fixation point 15 at the intersection of the first crossing restraint strip 105 and the second crossing restraint strip 106. The first and second longitudinal restraint strips 103, 104 are essentially coupled to the first and second crossing restraint strips 105, 106, and the first and second crossing restraint strips 105, 106 are essentially coupled to each other. The first fixation point 11, second fixation point 12, third fixation point 13, fourth fixation point 14 and fifth fixation point 15 are also affixed to a surface, or integrated into, the material of the wetsuit.

In some embodiments, the first crossing restraint strip and the second crossing restraint strip further comprise a first modulus of elasticity greater than a second modulus of elasticity of the wetsuit material to which it is affixed.

In some embodiments, the first crossing restraint strip 105 and the second crossing restraint strip 106 are configured to encourage a rolling rotation of the torso of the user's body when the wetsuit 100, 200 is worn by the user: by the second crossing restraint strip 106 pulling the first hip region 113 of the wetsuit (and hence the user's hip region) upward and toward the second armpit region 112, 203 of the wetsuit, while causing second hip region 114, 204 to roll downward when a second arm (on the same side as the second hip region) is raised in front of or above the user's head.

Conversely, the rolling rotation is reversed by the first crossing restraint strip 105 pulling the second hip region 114, 203 of the wetsuit (and hence the user's hip region) upward and toward the first armpit region 111 while causing the first hip region 113 to roll downward when a first arm (on the same side as the first hip region) is raised in front of or above the user's head.

In some embodiments, the wetsuit material comprises: a rubber material; a nylon material; a rayon material; a polyurethane material; an elastic polyurethane material; a polyester material; or any combination thereof.

In some embodiments, the first longitudinal restraint strip, second longitudinal restraint strip, first crossing restraint strip and second crossing restraint strips comprise: a rubber material; a textile material; a commercially pure titanium or titanium alloy; a commercially pure tantalum or tantalum alloy; a commercially pure copper or copper alloy; a silicone material; a neoprene material; a nylon material; a polypropylene material; a rayon material; a polyurethane material; an elastic polyurethane material; a polyester material; a Poly PBT material; a XLA material; or any combination thereof. In some embodiments, the first, second, third, fourth and fifth fixation points comprise: a glue; an epoxy; a rivet; a thread comprising: a polyester material, a nylon material, a cotton material, a silk material; a wool material, or a rayon material; an ultrasonic weld; or any combination thereof.

In some embodiments, any one of the first longitudinal restraint strip, second longitudinal restraint strip, first crossing restraint strip and second crossing restraint strip and the wetsuit comprise the same materials. In some embodiments, any one of the first longitudinal restraint strip, second longitudinal restraint strip, first crossing restraint strip and second crossing restraint strips and the wetsuit comprise different materials.

In some embodiments of the wetsuit; one or more of the first longitudinal restraint strip, second longitudinal restraint strip, first crossing restraint strip and second crossing restraint strips affixed to or incorporated into an internal material surface of the wetsuit; one or more of the first longitudinal restraint strip, second longitudinal restraint strip, first crossing restraint strip and second crossing restraint strips affixed to or incorporated into an external material surface of the wetsuit; one or more of the first longitudinal restraint strip, second longitudinal restraint strip, first crossing restraint strip and second crossing restraint strips affixed to or incorporated into a material surface between layers of the wetsuit; one or more of the first longitudinal restraint strip, second longitudinal restraint strip, first crossing restraint strip and second crossing restraint strips affixed to or incorporated into a material surface between internal panels of the wetsuit; or any combination thereof. In some embodiments of the wetsuit, a fixation medium between a surface of each of the first longitudinal restraint strip, second longitudinal restraint strip, first crossing restraint strip and second crossing restraint strips and an adjoining material surface of the wetsuit comprises: a glue comprising; a polyvinyl acetate, a polyurethane, a cyanoacrylates, a rubber glue, or a craft glue; an epoxy; a spray adhesive; an ultrasonic weld; or any combination thereof.

In any one of the embodiments of the aquatic sport performance garment or wetsuit described herein, the first longitudinal restraint strip and second longitudinal restraint strip material comprises: a percentage of elongation of about 10.0 percent in length; a percentage of elongation of about 10.0 percent in width.

In any one of the embodiments of the aquatic sport performance garment or wetsuit described herein, the first and second longitudinal restraint strips comprise: a stiffnesses within a range of about 5.0 percent to about 20 percent greater than the wetsuit material; a stiffnesses within a range of about 10.0 percent to about 20 percent greater than the wetsuit material; or a stiffnesses within a range of about 5.0 percent to about 40 percent greater than the wetsuit material.

In any one of the embodiments of the aquatic sport performance garment or wetsuit described herein, the first and second crossing restraints 105, 106, or variations of the crossing restraints 701*b*, 702 or 803, 804, comprise: a modulus of elasticity that is up to 50% greater than the wetsuit material; a modulus of elasticity that is up to 75% greater than the wetsuit material; or a modulus of elasticity that is over 75% greater than the wetsuit material.

In some embodiments of either the aquatic sport performance garment or the wetsuit described herein comprising first and second crossing restraints 105, 106, or variations of the crossing restraints 701*b*, 702 or 803, 804, the crossing restraint strips are further configured to mechanically connect a first shoulder region 115 of the wetsuit on a first side of the user's body with a second hip region 114, 204 of the wetsuit on the second side of the user's body, and the second shoulder 116, 205 region of the wetsuit on the second side of the user's body with a first hip region 113 of the wetsuit on the first side of the user's body.

In any one of the embodiments of the aquatic sport performance garment or wetsuit described herein comprising first and second crossing restraints 105, 106, or variations of the crossing restraints 701*b*, 702 or 803, 804; when a user reaches and extends either arm over the head, a corresponding superior shoulder region 115, 116 of the wetsuit on the same side of the body as the extended arm causes an opposite hip region 113 or 114, 204 of the wetsuit to be pulled up and over, triggering a body roll rotation of the user toward the side of the extended arm of the user.

Provided herein is a wetsuit garment configured to inhibit side-to-side bending of a torso and encourage a rolling rotation of the torso of the user when the garment is worn, the garment having a first armpit region, a second armpit region, a first hip region, and a second hip region, the wetsuit comprising: a continuous "N" shaped, inverted (upside-down) "N" shaped or stylized "N" shaped first restraint strip 701, such as that illustrated in FIG. 3B, comprising: a first unattached end 711 on a first leg 701*a*, a second unattached end 712 on a third leg 701*c*, and a second leg 701*b* positioned diagonally and connecting the attached end of the first leg 701*a* and attached end of the third leg 701*c* in a continuous "N" pattern, wherein the first leg 701 of the continuous "N" shaped, inverted "N" shaped or stylized "N" shaped restraint strip is affixed to a first material surface of a wetsuit material or is integrated into the wetsuit material, and is positioned such that the first leg 701*a* is approximately parallel to a sagittal plane 110 of a user when the wetsuit is worn, along a first lateral aspect of the wetsuit, from the first armpit region to the first hip region, wherein the third leg 701*c* of the continuous "N" shaped, inverted "N" shaped or stylized "N" shaped restraint strip is affixed to a second material surface of the wetsuit material opposite the first material surface or is integrated into the wetsuit material, and is positioned such that the third leg is approximately parallel to the sagittal plane 110 along a second lateral aspect of the aquatic sport performance garment from the second armpit region to the second hip region, and wherein the second diagonally positioned leg 701*b* of the continuous "N" shaped, inverted "N" shaped or stylized "N" shaped restraint strip is affixed to a third material surface across a back region of the wetsuit material or is integrated into the wetsuit material, and is positioned such that the second leg is posteriorly offset from a coronal plane 210 of the user when the garment is worn; a second restraint strip 702 comprising: a third end 713, a fourth end 714, wherein the second restraint strip 702 is affixed to the third material surface across a back region of the aquatic performance garment material or is integrated into the aquatic sport performance garment material, and is positioned diagonally such that the second restraint strip axis is posteriorly offset from a coronal plane 210 of the user when the garment is worn, wherein the third end 713 is positioned in contact with or in proximity to the first end 711 of the first leg 701*a* of the continuous "N" shaped, inverted "N" shaped or stylized "N" shaped restraint strip, and the fourth end 714 is positioned in contact with or in proximity to the second end 712 of the third leg 701*c* of the continuous "N" shaped, inverted "N" shaped or stylized "N" shaped restraint strip, wherein the "N" shaped, inverted "N" shaped or stylized "N" shaped restraint strip and the second restraint strip form an "⋈" pattern.

Figure 3C:
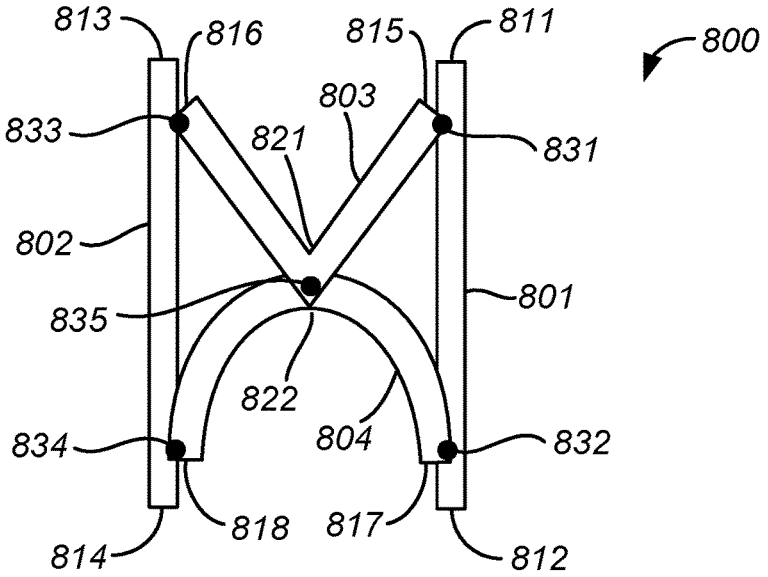
FIG. 3C is another simplified representative illustration of a restraint system showing the potential interaction between the longitudinal restraints "|" and stylized "U" and/or "V" criss-cross "ϒ", "ϒ", "ϒ" or "X" restraints, forming, for example, one of the following patterns "⋈", "⋈", "⋈" or "⋈".

Provided herein is a wetsuit garment such as that illustrated in FIG. 6, or another aquatic performance garment comprising a restraint system such as that illustrated in FIG. 3C, configured to inhibit side-to-side bending of a torso and to encourage a rolling rotation of the torso of the user when the garment is worn, the garment having a first armpit region, a second armpit region, a first hip region, and a second hip region, the wetsuit comprising: a first longitudinal restraint strip 601 comprising; a first end 611, a second end 612, and a first axis extending from the first end to the second end, wherein the first longitudinal restraint strip is affixed to a first material surface of a wetsuit material or is integrated into the wetsuit material, and is positioned such that the first axis is approximately parallel to a sagittal plane 110 of a user when the wetsuit is worn, along a first lateral aspect of the wetsuit from the first armpit region to the first hip region; a second longitudinal restraint strip 602 comprising; a third end 613, a fourth end 614, and a second axis extending from the third end to the fourth end, wherein the second longitudinal restraint strip is affixed to a second material surface of the wetsuit material or is integrated into the wetsuit material, and is positioned such that the second axis is approximately parallel to the sagittal plane 110 along a second lateral aspect of the wetsuit from the second armpit region to the second hip region; a first "U"-shaped, "V"-shaped or stylized "U"-shaped restraint strip 603 comprising: a fifth end 605; and a sixth end 606 wherein the first "U"-shaped, "V"-shaped or stylized "U"-shaped restraint strip is positioned across a third posterior material surface such that the fifth end 605 of the first "U"-shaped, "V"-shaped or stylized "U"-shaped restraint strip is in proximity to or connected to the first end 611 of the first longitudinal restraint strip 601 and the sixth end 606 of the first "U"-shaped, "V"-shaped or stylized "U"-shaped restraint strip is in proximity to or connected to the third end 613 of the second longitudinal restraint strip 602. A second "U"-shaped, "V"-shaped or stylized "U"-shaped restraint strip 604 comprising: a seventh end 607; and an eighth end 608; wherein the second "U"-shaped, "V"-shaped or stylized "U"-shaped restraint strip 604 is positioned across the third posterior material surface such that the seventh end 607 of the second "U"-shaped, "V"-shaped or stylized "U"-shaped restraint strip is in proximity to or connected to the second end 612 of the first longitudinal restraint strip 601 and the eighth end 608 of the second "U"-shaped, "V"-shaped or stylized "U"-shaped restraint strip is in proximity to or connected to the fourth end 614 of the second longitudinal restraint strip 602. The first "U"-shaped, "V"-shaped or stylized "U"-shaped restraint strip 605 and the second "U"-shaped, "V"-shaped or stylized "U"-shaped restraint strip 606 are positioned in contact with or in proximity to each other at or about a first apex region 609 of the first "U"-shaped, "V"-shaped or stylized "U"-shaped restraint strip 605 and a second apex region 610 of the second "U"-shaped, "V"-shaped or stylized "U"-shaped restraint strip 604. The first apex region 609 and the second apex region 610 intersect the sagittal plane 210 of the third posterior material surface of the wetsuit forming a modified criss-cross pattern.

In some embodiments of the the wetsuit comprising alternate configurations of crossing restraint configurations, the garments further comprises: a first fixation point 631 in contact with or in proximity to the first end 611 of the first longitudinal restraint strip 601 and an end 605 of one of the crossing restraint strips 603; a second fixation point 633 in contact with or in proximity to the second end 612 of the first longitudinal restraint strip 601 and another end 607 of one of the crossing restraint strips 604; a third fixation point 632 in contact with or in proximity to the third end 613 of the second longitudinal restraint strip 602 and another end 606 of one of the crossing restraint strips 604; a fourth fixation point 634 in contact with or in proximity to the fourth end 614 of the second longitudinal restraint strip 602 and a last end 608 of one of the crossing restraint strips 604. In some embodiments, the wetsuit further comprises: a fixation point 635 about the first apex of the first "U"-shaped, "V"-shaped or stylized "U"-shaped restraint strip 603 and the second apex of the second "U"-shaped, "V"-shaped or stylized "U"-shaped restraint strip 604; wherein the first and second apex are essentially coupled to each other and to the wetsuit.

In any embodiment of the aquatic sports performance garment or wetsuit, the garment comprises: long arm sleeves beyond the elbow, short arm sleeves above the elbow, or no sleeves beyond the shoulder region.

In any embodiment of the aquatic sports performance garment or wetsuit, the garment comprises: long pant legs below the knees, or short pant legs above the knees, or no pant legs below the crotch region.

Provided herein is a method of manufacturing a wetsuit such as 100, having restraints comprising: patterning an upper body portion 101; patterning a lower-body portion 102; adjoining the lower-body portion to the upper body portion to form a full body wetsuit; patterning a first longitudinal restraint strip such as 103 and a second longitudinal restraint strip such as 104, the first longitudinal restraint strip with a first end and a second end, the second longitudinal restraint strip with a third end and fourth end; patterning a first diagonal restraint strip such as 105 and a second diagonal restraint strip such as 105, the first diagonal restraint strip with a fifth end and a sixth end, the second diagonal restraint strip with a seventh end and an eighth end, and restraining the wetsuit by; affixing the first longitudinal restraint strip from a first armpit region such as 111 to a first hip region such as 113 of a first lateral aspect of a material of the wetsuit, approximately parallel to a sagittal plane 110 of a user when the wetsuit is worn, affixing the second longitudinal restraint strip from a second armpit region such as 112 to a second hip region such as 114 of a second lateral aspect of the material of the wetsuit, opposite the first lateral aspect, approximately parallel to the sagittal plane 110 of the user when the wetsuit is worn, affixing the first diagonal restraint strip to a third material surface across a back region of the wetsuit material generally located within a midsection region such as 107 of the wetsuit such that it is posteriorly offset from a coronal plane 210 of the user when the garment is worn, and affixing the second diagonal restraint strip to the third material surface across the back region of the wetsuit material such that it is posteriorly offset from the coronal plane of the user when the garment is worn, wherein the fifth end of the first diagonal strip is positioned in contact with or in proximity to the first end of the first longitudinal restraint strip, and the sixth end is positioned in contact with or in proximity to the fourth end of the second longitudinal restraint strip; wherein the fifth end of the first diagonal strip is positioned in contact with or in proximity to the first end of the first longitudinal restraint strip, and the sixth end is positioned in contact with or in proximity to the fourth end of the second longitudinal restraint strip; wherein the seventh end of the second diagonal strip is positioned in contact with or in proximity to the third end of the second longitudinal restraint strip, and the eighth end is positioned in contact with or in proximity to the second end of the first longitudinal restraint strip, wherein the first diagonal restraint strip and the second diagonal restraint strip form an intersecting "X" pattern.

In some embodiments of the method, each first longitudinal restraint strip, second longitudinal restraint strip, first diagonal restraint strip or second diagonal restraint strip is; affixed to or incorporated into an internal material surface of the wetsuit; affixed to or incorporated into an external material surface of the wetsuit; affixed to or incorporated between layers of the wetsuit; affixed to or incorporated between panels of the wetsuit; or any combination thereof.

In some embodiments of the method, the restraints are affixed to or into the wetsuit or to each other using a sewn thread; compressive heat; a glue; an epoxy; a spray adhesive; an ultrasonic weld; or any combination thereof.

Provided herein is a method of reducing side-to-side hip bending and promoting a streamline profile of a swimmer's torso while swimming comprising: providing an aquatic garment to be worn by the swimmer having an upper body portion 101 to cover a swimmer's upper torso and a lower-body portion 102, adjoining the upper body portion, to cover a portion of a swimmer's lower torso to at least an upper thigh region of a swimmer's legs; providing a first longitudinal restraint strip with a first end and a second end longitudinally affixed to or integrated into a first material surface along a first lateral aspect of the aquatic garment, wherein the first end is affixed in a first armpit region of the first lateral aspect and the second end is affixed in a first hip region of the first lateral aspect; providing a second longitudinal restraint strip with a third end and a fourth end affixed to or integrated into a second material surface along a second lateral aspect opposite the first lateral aspect, wherein the third end is positioned in a second armpit region of the second lateral aspect and the fourth end is positioned in a second hip region of the second lateral aspect; providing a first crossing restraint strip with a fifth end and a sixth end affixed to or integrated into a third material surface across the back of the aquatic garment, wherein the fifth end of the first crossing restraint strip is positioned in proximity to or in contact with the first end of the first longitudinal restraint strip and the sixth end of the first crossing restraint strip is positioned in proximity to or in contact with the fourth end of the second longitudinal restraint strip; and providing a second crossing restraint strip with a seventh end and a eighth end affixed to or integrated into the third material surface across the back of the aquatic garment, wherein the eighth end of the second crossing restraint strip is positioned in proximity to or in contact with the second end of the first longitudinal restraint strip and the seventh end of the second crossing restraint strip is positioned in proximity to or in contact with the third end of the second longitudinal restraint strip. In some embodiments, the method further comprises providing the first longitudinal restraint strip with a stiffness greater than the aquatic garment that resists lateral bending between a first fixation point in the first armpit region and a third fixation point in the first hip region, and providing the second longitudinal restraint strip with a stiffness greater than the aquatic garment that resists lateral bending between a second fixation point in the second armpit region and a fourth fixation point in the second hip region. In some embodiments, the method further comprises: providing the first crossing restraint strip with a third modulus of elasticity, less than a second modulus of elasticity of the aquatic garment, encouraging a twisting rotation about a longitudinal axis of the user's torso by pulling the first hip region on the first lateral side of the swimmer's body upward and over in a rolling motion toward the second armpit region while causing the second hip region do drop downward when a second arm is raised above and in front of the swimmer's head on the second lateral side; and providing the second crossing restraint strip with a third modulus of elasticity, less than a second modulus of elasticity of the aquatic garment, encouraging a twisting rotation about a longitudinal axis of the swimmer's torso by pulling the second hip region on the second lateral side of the swimmer's body upward and over in a rolling motion toward the first armpit region while causing the first hip region to drop downward when a first arm is raised above and in front of the swimmer's head on the first lateral side.

Provided herein is a restraint system configured to inhibit side-to-side bending of the torso of a user's body when the restraint system is utilized by the user while swimming, the restraint system comprising: a first longitudinal restraint strip comprising; a first end, a second end, and a first axis extending from the first end to the second end, wherein the first longitudinal restraint strip is affixable to a first surface of a human body first or a material surface an aquatic sport performance garment material or is integrated into the aquatic sport performance garment material, and is positioned such that the first axis is approximately parallel to a sagittal plane of the user or the garment when the garment is worn, along a first lateral aspect of the of the user's body or along a first lateral aspect of the aquatic sport performance garment, from a first armpit region to a first hip region; and a second longitudinal restraint strip comprising; a third end, a fourth end, and a second axis extending from the third end to the fourth end, wherein the second longitudinal restraint strip is affixable to a second surface of a human body or a second material surface of the aquatic sport performance garment material or is integrated into the aquatic sport performance garment material, and is positioned such that the second axis is approximately parallel to the sagittal plane of the user or the garment when the garment is worn, along a second lateral aspect of the of the user's body or the aquatic sport performance garment from a second armpit region to a second hip region. In some embodiments, the restraint system is further configured to encourage a rolling rotation of the torso of the user and further comprises: a first crossing restraint strip comprising, a fifth end, a sixth end, wherein the first crossing restraint strip is affixable to a back of a user or a third material surface across a back region of the aquatic performance garment material or is integrated into the aquatic sport performance garment material, and is positioned diagonally such that the first crossing restraint strip is posteriorly offset from a coronal plane of the user or the garment when the garment is worn, wherein the fifth end is positioned in contact with or in proximity to the first end of the first longitudinal restraint strip, and the sixth end is positioned in contact with or in proximity to the fourth end of the second longitudinal restraint strip; and a second crossing restraint strip comprising a seventh end, an eighth end, wherein the second crossing restraint strip is affixable to the back of the user or the third material surface across the back region of the aquatic performance garment material or is integrated into the aquatic sport performance garment material, and is positioned diagonally such that the second crossing restraint strip is posteriorly offset from the coronal plane of the user or the garment when the garment is worn, wherein the seventh end is positioned in contact with or in proximity to the third end of the second longitudinal restraint strip, and the eighth end of the second crossing restraint strip is positioned in contact with or in proximity to the second end of the first longitudinal restraint strip, wherein the first crossing restraint strip and the second crossing restraint strip form an intersecting "X" pattern when assembled and affixed. In some embodiments, the first crossing restraint strip and the second crossing restraint strip are configured to encourage a rolling rotation of the torso of the user when affixed to the user or when the garment is worn.

Provided herein is a restraint system, such as that illustrated in FIG. 3B, configured to inhibit side-to-side bending of the torso of a user's body and to encourage a rolling rotation of the torso of the user's body when the restraint system is utilized by the user while swimming, the restraint system comprising: a continuous "N" shaped, inverted (upside-down) "N" shaped or stylized "N" shaped first restraint strip comprising: a first unattached end on a first leg, a second unattached end on a third leg, and a second leg positioned diagonally and connecting the attached end of the first leg and attached end of the third leg in a continuous "N" pattern, wherein the first leg of the continuous "N" shaped, inverted "N" shaped or stylized "N" shaped restraint strip is affixable to a human body or to a material surface of an aquatic sports performance garment material or is integrated into the aquatic sports performance garment material, and is positioned such that the first leg is approximately parallel to a sagittal plane of a user or the aquatic sports performance garment, when the garment is worn, along a first lateral aspect of the user or the aquatic sports performance garment, from a first armpit region to a first hip region, wherein the third leg of the continuous "N" shaped, inverted "N" shaped or stylized "N" shaped restraint strip is affixable to the user or a second material surface of the aquatic sports performance garment material opposite the first material surface or is integrated into the aquatic sports performance garment material, and is positioned such that the third leg is approximately parallel to the sagittal plane along a second lateral aspect of the user or the aquatic sport performance garment from a second armpit region to a second hip region, and wherein the second diagonally positioned leg of the continuous "N" shaped, inverted "N" shaped or stylized "N" shaped restraint strip is affixable to a back of the user or a third material surface across a back region of the aquatic sports performance garment material or is integrated into the aquatic sports performance garment material, and is positioned such that the second leg is posteriorly offset from a coronal plane of the user or the garment, when the garment is worn; a second restraint strip comprising: a third end and a fourth end, wherein the second restraint strip is affixable to the back of the user or the third material surface across a back region of the aquatic performance garment material or is integrated into the aquatic sport performance garment material, and is positioned diagonally such that the second restraint strip axis is posteriorly offset from a coronal plane of the user or the garment, when the garment is worn, wherein the third end is positioned in contact with or in proximity to the first end of the first leg of the continuous "N" shaped, inverted "N" shaped or stylized "N" shaped restraint strip, and the fourth end is positioned in contact with or in proximity to the second end of the third leg of the continuous "N" shaped, inverted "N" shaped or stylized "N" shaped restraint strip, wherein the "N" shaped, inverted "N" shaped or stylized "N" shaped restraint strip and the second restraint strip form an "⋈" pattern when assembled and affixed.

Similar to the restraint system of FIG. 3A, some embodiments of the "U"-shaped, "V"-shaped or stylized "U"-shaped restraint strip system 700 also comprise fixation points, such as 721, 722, 723, 724 and a fixation point 725 at the intersection of the second diagonally positioned leg of the continuous "N" shaped, inverted "N" shaped or stylized "N" shaped restraint strip and the second crossing restraint strip; wherein the first and second crossing restraint strips are essentially coupled to each other and to the wetsuit, and wherein, all of the fixation points function in the same manner and are similarly attached as the fixation points 14, 12, 13, 11 and 15 illustrated in FIG. 3A.

Provided herein is a restraint strip system illustrated in FIG. 3 and again as it would be applied to an aquatic sports performance garment or wetsuit in FIG. 6, configured to inhibit side-to-side bending of the torso of a user's body when the restraint system is utilized by the user while swimming, the restraint system comprising: a first longitudinal restraint strip comprising; a first end, a second end, and a first axis extending from the first end to the second end, wherein the first longitudinal restraint strip is affixable to a human body or to a first material surface of an aquatic sports performance garment material or is integrated into the aquatic sports performance garment material, and is positioned such that the first axis is approximately parallel to a sagittal plane of a user or the garment when the aquatic sports performance garment is worn, along a first lateral aspect of the body or the aquatic sports performance garment from a first armpit region to a first hip region; a second longitudinal restraint strip comprising; a third end, a fourth end, and a second axis extending from the third end to the fourth end, wherein the second longitudinal restraint strip is affixable to a second surface of the body or a second material surface or the aquatic sports performance garment or is integrated into the aquatic sports performance garment material, and is positioned such that the second axis is approximately parallel to the sagittal plane along a second lateral aspect of the body or the aquatic sports performance garment, from a second armpit region to a second hip region. In some embodiments, the restraint system is further configured to encourage a rolling rotation of the torso of the user and further comprises: a first "U"-shaped, "V"-shaped or stylized "U"-shaped restraint strip comprising: a fifth end; and a sixth end wherein the first "U"-shaped, "V"-shaped or stylized "U"-shaped restraint strip is positionable across the back of the user or a third posterior material surface of the garment such that the fifth end of the first "U"-shaped, "V"-shaped or stylized "U"-shaped restraint strip is in proximity to or connected to the first end of the first longitudinal restraint strip and the sixth end of the first "U"-shaped, "V"-shaped or stylized "U"-shaped restraint strip is in proximity to or connected to the third end of the second longitudinal restraint strip; and a second "U"-shaped, "V"-shaped or stylized "U"-shaped restraint strip comprising: a seventh end; and an eighth end; wherein the second "U"-shaped, "V"-shaped or stylized "U"-shaped restraint strip is positionable across the back of the user or the third posterior material surface of the garment such that the seventh end of the second "U"-shaped, "V"-shaped or stylized "U"-shaped restraint strip is in proximity to or connected to the second end of the first longitudinal restraint strip and the eighth end of the second "U"-shaped, "V"-shaped or stylized "U"-shaped restraint strip is in proximity to or connected to the fourth end of the second longitudinal restraint strip; wherein the first "U"-shaped, "V"-shaped or stylized "U"-shaped restraint strip and the second "U"-shaped, "V"-shaped or stylized "U"-shaped restraint strip are positionable in contact with or in proximity to each other at or about a first apex region of the first "U"-shaped, "V"-shaped or stylized "U"-shaped restraint strip and a second apex region of the second "U"-shaped, "V"-shaped or stylized "U"-shaped restraint strip, and wherein the first apex region and the second apex region intersect the sagittal plane of the user at the user's back or at the third posterior material surface of the aquatic sports performance garment, forming a modified criss-cross pattern, such as one of the following patterns; "⋈", "⋈", "⋈" or "⋈".

Similar to the restraint systems of FIGS. 3A and 3B, some embodiments of the "U"-shaped, "V"-shaped or stylized "U"-shaped restraint strip system 800 also comprise fixation points, such as 831, 832, 833, 834 and a fixation point 835 about the first apex 821 of the first "U"-shaped, "V"-shaped or stylized "U"-shaped restraint strip and the second apex 822 of the second "U"-shaped, "V"-shaped or stylized "U"-shaped restraint strip; wherein the first and second apex are essentially coupled to each other and to the wetsuit, wherein, all of the fixation points function in the same manner and are similarly attached as the fixation points 14, 12, 13, 11 and 15 illustrated in FIG. 3A.

Provided herein is a method of manufacturing a restraint system configured to reduce side-to-side bending of the torso of a user's body when the restraint system is utilized by the user while swimming, the method comprising: patterning a first restraint strip having a first end and a second end and affixable to a first lateral aspect of user's body or a corresponding first lateral material surface of an aquatic garment; and patterning a second restraint strip having a third end and a fourth end and affixable to a second lateral aspect of the user's body or a corresponding second lateral material surface of the aquatic garment; providing a fixation medium affixable to a surface of each of the first and second restraint strips capable of adhering at least temporarily to the skin of the user or a material surface of the aquatic garment; providing instructions for application of the first and second restraint strip to the user's body or the aquatic garment; wherein the first end of the first restraint strip is positionable at or about a first armpit region of the first lateral aspect of the user's body or garment, the second end of the first restraint strip is positionable at or about a first hip region of the first lateral aspect of the user's body or garment, the third end of the second restraint strip is positionable in a second armpit region of the second lateral aspect of the user's body or garment, and the fourth end of the second restraint strip is positioned in a second hip region of the second lateral aspect of the user's body or garment.

In some embodiments of the method of manufacturing a restraint system, the restraint system is further configured to encourage a rolling rotation of the torso of the user and the method further comprises: patterning a first crossing restraint strip having a fifth end and a sixth end and affixable across the back of the user's body or a posterior material surface of the aquatic garment; patterning a second crossing restraint strip having a seventh end and an eighth end and affixable across the back of the user's body or the posterior material surface of the aquatic garment; providing a fixation medium affixable to a surface of each first and second crossing restraint strip capable of adhering at least temporarily to the skin of the user or the material surface of the aquatic garment; providing instructions for application of the first and second crossing restraint strip to the user's body or the aquatic garment; wherein the fifth end of the first crossing restraint strip is positioned in proximity to or in contact with the first end of the first restraint strip and the sixth end of the first crossing restraint strip is positioned in proximity to or in contact with the fourth end of the second restraint strip; wherein the seventh end of the second crossing restraint strip is positioned in proximity to or in contact with the third end of the second restraint strip and the eighth end of the second crossing restraint strip is positioned in proximity to or in contact with the second end of the first restraint strip, and wherein the application of the first and second crossing restraint strips across the back of the user's body or the back of the aquatic garment worn by the user improve overall swimming mechanics by encouraging coordinated hip and shoulder movements when swimming when the restraint system is applied to the skin of the user or the aquatic garment comprising the restraint system is worn by the user.

In some embodiments of the method, a thickness of any one of the restraint strips is in a range from about 0.05 mm to about 8.00 mm. In some embodiments of the method, the application of the restraint system to the user's body or the aquatic garment when worn by the user, cause the user's body to maintain a straighter longitudinal body profile and reduced longitudinal drag when swimming.

In some embodiments of the method, any one of the restraint strips further comprises widths in a range of about 0.1 cm to about 16.0 cm; and further comprises lengths in a range from about 5.0 cm to about 90.0 cm.

In some embodiments of the method, each restraint strip is: affixable to the skin of the user's body; affixable to an internal material surface of the aquatic garment; or affixable to an external material surface of the aquatic garment.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An aquatic sport performance garment configured to inhibit side-to-side bending of a torso of a user when the garment is worn, the garment having a first armpit region, a second armpit region, a first hip region, and a second hip region, the garment comprising:

a first longitudinal restraint strip comprising;

a first end, a second end, and a first axis extending from the first end to the second end, wherein the first longitudinal restraint strip is affixed to a first material surface of an aquatic performance garment material or is integrated into the aquatic sport performance garment material, and is positioned such that the first axis is approximately parallel to a sagittal plane of a user when the garment is worn along a first lateral aspect of the aquatic sport performance garment from the first armpit region to the first hip region; and a second longitudinal restraint strip comprising;

a third end, a fourth end, and a second axis extending from the third end to the fourth end, wherein the second longitudinal restraint strip is affixed to a second material surface of the aquatic performance garment material or is integrated into the aquatic sport performance garment material, and is positioned such that the second axis is approximately parallel to the sagittal plane along a second lateral aspect of the aquatic sport performance garment from the second armpit region to the second hip region.

2. The aquatic sport performance garment of claim 1, further comprising:

a first diagonal restraint strip comprising, a fifth end, a sixth end, and a third axis extending from the fifth end to the sixth end, wherein the first diagonal restraint strip is affixed to a third material surface across a back region of the aquatic performance garment material or is integrated into the aquatic sport performance garment material, and is positioned diagonally such that the third axis is posteriorly offset from a coronal plane of the user when the garment is worn, wherein the fifth end is positioned in contact with or in proximity to the first end of the first longitudinal restraint strip, and the sixth end is positioned in contact with or in proximity to the fourth end of the second longitudinal restraint strip; and a second diagonal restraint strip comprising a seventh end, an eighth end, and a fourth axis extending from the seventh end to the eighth end wherein the second diagonal restraint strip is affixed to the third material surface across the back region of the aquatic performance garment material or is integrated into the aquatic sport performance garment material, and is positioned diagonally such that the fourth axis is posteriorly offset from the coronal plane, wherein the seventh end is positioned in contact with or in proximity to the third end of the second longitudinal restraint strip, and the eighth end of the second diagonal restraint strip is positioned in contact with or in proximity to the second end of the first longitudinal restraint strip, wherein the first diagonal restraint strip and the second diagonal restraint strip form an intersecting "X" pattern, wherein the first diagonal restraint strip and the second diagonal restraint strip are configured to encourage a rolling rotation of the torso of the user when the garment is worn.

3. The aquatic sport performance garment of claim 1, wherein the first longitudinal restraint strip and the second longitudinal restraint strip further comprise a first modulus of elasticity that is approximately two or more times greater than a second modulus of elasticity of the aquatic sport performance garment material to which it is affixed or into which it is integrated.

4. The aquatic sport performance garment of claim 2, wherein the first diagonal restraint strip and the second diagonal restraint strip further comprise a third modulus of elasticity that is approximately two or more times greater than the second modulus of elasticity of the aquatic sport performance garment material to which it is affixed or integrated.

5. An aquatic sport performance garment configured to encourage a rolling rotation of the torso of a user when the garment is worn, the garment having a first armpit region, a second armpit region, a first hip region, and a second hip region, the garment comprising:

a first diagonal restraint strip comprising, a fifth end, a sixth end, and a third axis extending from the fifth end to the sixth end, wherein the first diagonal restraint strip is affixed to a third material surface across a back region of the aquatic performance garment material or is integrated into the aquatic sport performance garment material, and is positioned diagonally such that the third axis is posteriorly offset from a coronal plane of the user when the garment is worn, wherein the fifth end is positioned and affixed along a first lateral aspect of the performance garment at or about the first armpit region approximately parallel to a sagittal plane of the user when the garment is worn, and the sixth end is positioned and affixed along a second lateral aspect of the performance garment at or about the second hip region approximately parallel to the sagittal plane, and a second diagonal restraint strip comprising, a seventh end, an eighth end, and a fourth axis extending from the seventh end to the eighth end, wherein the second diagonal restraint strip is affixed to the third material surface across the back region of the aquatic performance garment material or is integrated into the aquatic sport performance garment material, and is positioned diagonally such that the fourth axis is posteriorly offset from the coronal plane, wherein the seventh end is positioned and affixed along the second lateral aspect of the performance garment at or about the second armpit region approximately parallel to the sagittal plane, and the eighth end is positioned and affixed along the first lateral aspect of the performance garment at or about the first hip region approximately parallel to the sagittal plane;

wherein the first diagonal restraint strip and the second diagonal restraint strip form an intersecting "X" pattern, and wherein the first diagonal restraint strip and the second diagonal restraint strip further comprise a third modulus of elasticity that is approximately two or more times greater than a second modulus of elasticity of the aquatic sport performance garment material to which they are affixed or into which they are integrated.

6. The aquatic sport performance garment of claim 5, further comprising:

a first longitudinal restraint strip comprising;

a first end, a second end, and a first axis extending from the first end to the second end, wherein the first longitudinal restraint strip is affixed to a first material surface of an aquatic performance garment material or is integrated into the first material surface of the aquatic sports performance garment material, and is positioned such that the first axis is approximately parallel to the sagittal plane along the first lateral aspect of the performance garment approximately from the first armpit region to the first hip region; and a second longitudinal restraint strip comprising;

a third end, a fourth end, and a second axis extending from the third end to the fourth end, wherein the second longitudinal restraint strip is affixed to a second material surface of the aquatic performance garment material or is integrated into the second material surface of the aquatic sport performance garment material, and is positioned such that the second axis is approximately parallel to the sagittal plane along the second lateral aspect of the performance garment approximately from the second armpit region to the second hip region, wherein the first longitudinal restraint strip and second longitudinal restraint strip are configured to inhibit side-to-side bending of a torso of a user when the garment is worn.

7. The aquatic sport performance garment of claim 6, wherein the first longitudinal restraint strip and the second longitudinal restraint strip comprise a first modulus of elasticity that is approximately two or more times greater than the second modulus of elasticity of the aquatic performance garment material to which it is affixed or into which it is integrated.

8. The aquatic sport performance garment of claim 6, wherein the first longitudinal restraint strip and the second longitudinal restraint strip comprise a first material stiffness greater than a second material stiffness of the aquatic sports performance garment material to which it is affixed, and wherein the first or second material stiffness comprises an axial stiffness or a rotational stiffness.

9. The aquatic sport performance garment of claim 2, wherein the material of the aquatic sports performance garment comprises:

a rubber material;

a nylon material;

a rayon material;

a polyurethane material;

an elastic polyurethane material;

a polyester material; or any combination thereof.

10. The aquatic sport performance garment of claim 6, wherein the material of the aquatic sports performance garment comprises:

a rubber material;

a nylon material;

a rayon material;

a polyurethane material;

an elastic polyurethane material;

a polyester material; or any combination thereof.

11. The aquatic sport performance garment of claim 9, wherein the first longitudinal restraint strip, second longitudinal restraint strip, first diagonal restraint strip and second diagonal restraint strips comprise:

a rubber material;

a textile material;

a commercially pure titanium or titanium alloy;

a commercially pure tantalum or tantalum alloy;

a commercially pure copper or copper alloy;

a silicone material;

a neoprene material;

a nylon material;

a polypropylene material;

a rayon material;

a polyurethane material;

an elastic polyurethane material;

a polyester material;

a Poly PBT material;

a XLA material; or any combination thereof.

12. The aquatic sport performance garment of claim 10, wherein the first longitudinal restraint strip, second longitudinal restraint strip, first diagonal restraint strip and second diagonal restraint strips comprise:

a rubber material;

a textile material;

a commercially pure titanium or titanium alloy;

a commercially pure tantalum or tantalum alloy;

a commercially pure copper or copper alloy;

a silicone material;
a neoprene material;
a nylon material;
a polypropylene material;
a rayon material;
an polyurethane material;
an elastic polyurethane material;
a polyester material;
a Poly PBT material;
a XLA material; or
any combination thereof.

13. The aquatic sport performance garment of claim 11, wherein any one of the first longitudinal restraint strip, second longitudinal restraint strip, first diagonal restraint strip and second diagonal restraint strips and the aquatic sport performance garment material comprise the same materials.

14. The aquatic sport performance garment of claim 12, wherein any one of the first longitudinal restraint strip, second longitudinal restraint strip, first diagonal restraint strip and second diagonal restraint strips and the aquatic sport performance garment material comprise the same materials.

15. The aquatic sport performance garment of claim 11, wherein any one of the first longitudinal restraint strip, second longitudinal restraint strip, first diagonal restraint strip and second diagonal restraint strips and the aquatic sport performance garment material comprise different materials.

16. The aquatic sport performance garment of claim 12, wherein any one of the first longitudinal restraint strip, second longitudinal restraint strip, first diagonal restraint strip and second diagonal restraint strips and the aquatic sport performance garment material comprise different materials.

17. The aquatic sport performance garment of claim 2, further comprising:

any one or more of the first longitudinal restraint strip, second longitudinal restraint strip, first diagonal restraint strip and second diagonal restraint strips affixed to or incorporated into an internal material surface of the aquatic sport performance garment;

any one or more of the first longitudinal restraint strip, second longitudinal restraint strip, first diagonal restraint strip and second diagonal restraint strips affixed to or incorporated into an external material surface of the aquatic sport performance garment;

any one or more of the first longitudinal restraint strip, second longitudinal restraint strip, first diagonal restraint strip and second diagonal restraint strips affixed to or incorporated into a material surface between layers of the aquatic sport performance garment;

any one or more of the first longitudinal restraint strip, second longitudinal restraint strip, first diagonal restraint strip and second diagonal restraint strips affixed to or incorporated into a material surface between internal panels of the aquatic sport performance garment; or any combination thereof.

18. The aquatic sport performance garment of claim 6, further comprising:

any one or more of the first longitudinal restraint strip, second longitudinal restraint strip, first diagonal restraint strip and second diagonal restraint strips affixed to or incorporated into an internal material surface of the aquatic sport performance garment;

any one or more of the first longitudinal restraint strip, second longitudinal restraint strip, first diagonal restraint strip and second diagonal restraint strips affixed to or incorporated into an external material surface of the aquatic sport performance garment;

any one or more of the first longitudinal restraint strip, second longitudinal restraint strip, first diagonal restraint strip and second diagonal restraint strips affixed to or incorporated into a material surface between layers of the aquatic sport performance garment;

any one or more of the first longitudinal restraint strip, second longitudinal restraint strip, first diagonal restraint strip and second diagonal restraint strips affixed to or incorporated into a material surface between internal panels of the aquatic sport performance garment; or any combination thereof.

19. The aquatic sport performance garment of claim 1, wherein said garment comprises;

a wetsuit;
a swimsuit;
a body suit;
a compression garment; or
a combination thereof.

20. The aquatic sport performance garment of claim 5, wherein said garment comprises;

a wetsuit;
a swimsuit;
a body suit;
a compression garment; or
a combination thereof.

* * * * *